US012312765B2

(12) United States Patent
Gross et al.

(10) Patent No.: US 12,312,765 B2
(45) Date of Patent: May 27, 2025

(54) DIPPER DOOR AND DIPPER DOOR TRIP ASSEMBLY

(71) Applicant: Joy Global Surface Mining Inc, Milwaukee, WI (US)

(72) Inventors: Matthew L. Gross, West Allis, WI (US); Joseph J. Colwell, Hubertus, WI (US); Richard Nicoson, Hartford, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 664 days.

(21) Appl. No.: 17/379,360

(22) Filed: Jul. 19, 2021

(65) Prior Publication Data

US 2022/0010518 A1 Jan. 13, 2022

Related U.S. Application Data

(63) Continuation of application No. 15/877,049, filed on Jan. 22, 2018, now Pat. No. 11,066,807, which is a continuation of application No. 14/497,003, filed on Sep. 25, 2014, now Pat. No. 9,890,515.

(60) Provisional application No. 61/968,030, filed on Mar. 20, 2014, provisional application No. 61/883,982, filed on Sep. 27, 2013.

(51) Int. Cl.

| | |
|---|---|
| ***E02F 3/407*** | (2006.01) |
| ***E02F 3/30*** | (2006.01) |
| ***E02F 3/58*** | (2006.01) |

(52) U.S. Cl.

CPC ..... *E02F 3/4075* (2013.01); *E02F 3/308* (2013.01); *E02F 3/58* (2013.01)

(58) Field of Classification Search

CPC ..... E02F 3/4075; E02F 3/308; E02F 3/58

See application file for complete search history.

(56) References Cited

U.S. PATENT DOCUMENTS

| | | | | |
|---|---|---|---|---|
| 1,338,219 | A | 4/1920 | Dutcher | |
| 1,470,332 | A * | 10/1923 | Schulte | E02F 3/4075 414/726 |
| 1,478,301 | A | 12/1923 | Shea | |
| 1,574,492 | A | 2/1926 | Werner et al. | |
| 1,574,763 | A | 3/1926 | Stevens | |

(Continued)

FOREIGN PATENT DOCUMENTS

| | | |
|---|---|---|
| RU | 91083 U1 | 1/2010 |
| SU | 651089 A1 | 3/1979 |

OTHER PUBLICATIONS

Peruvian Patent Office Action for Related Application No. 1281-2018 dated Oct. 24, 2022 (12 pages, including an English translation).

(Continued)

*Primary Examiner* — Jessica H Lutz

(74) *Attorney, Agent, or Firm* — Husch Blackwell LLP

(57) ABSTRACT

A mining machine includes a boom, a handle coupled to the boom, a dipper coupled to the handle, and a dipper door pivotally coupled to the dipper. The mining shovel also includes a dipper door trip assembly including a trip motor coupled to the boom, a trip drum coupled to the handle, a linkage assembly coupled to the dipper door, a first actuation element extending directly from the trip motor to the trip drum, and a second actuation element extending directly from the trip drum to the linkage assembly.

11 Claims, 19 Drawing Sheets

(56) References Cited

U.S. PATENT DOCUMENTS

| | | | | | |
|---|---|---|---|---|---|
| 1,637,689 | A | | 8/1927 | Endersby | |
| 1,653,620 | A | | 12/1927 | Clark | |
| 1,660,598 | A | | 2/1928 | Crane | |
| 1,709,466 | A | | 4/1929 | Downie | |
| 1,712,040 | A | | 5/1929 | Houghton | |
| 1,725,858 | A | | 8/1929 | Esters et al. | |
| 1,765,089 | A | * | 6/1930 | George | E02F 9/2016 414/726 |
| 1,773,066 | A | | 8/1930 | Garfield | |
| 1,797,642 | A | | 3/1931 | Downie | |
| 1,848,643 | A | * | 3/1932 | Morin | E02F 3/4075 37/445 |
| 1,905,191 | A | | 4/1933 | Snow, Jr. | |
| 1,977,287 | A | * | 10/1934 | Olson | E02F 3/304 414/726 |
| 2,049,885 | A | | 8/1936 | Younie | |
| 2,160,432 | A | | 5/1939 | Davidson | |
| 2,238,414 | A | | 4/1941 | Erickson | |
| 2,335,352 | A | | 11/1943 | Murtaugh | |
| 2,372,311 | A | * | 3/1945 | Brown | E02F 9/2004 180/6.7 |
| 2,374,108 | A | | 4/1945 | Larsen | |
| 2,376,597 | A | | 5/1945 | Jones | |
| 2,543,247 | A | | 2/1951 | Larsen | |
| 2,544,682 | A | | 3/1951 | Hilgeman | |
| 2,722,325 | A | | 11/1955 | Dempster | |
| 3,369,324 | A | | 2/1968 | Tremblay et al. | |
| 5,289,092 | A | | 2/1994 | Schmid | |
| 5,469,647 | A | | 11/1995 | Profio | |
| 5,609,371 | A | | 3/1997 | Mader et al. | |
| 5,815,958 | A | | 10/1998 | Olds et al. | |
| 5,815,960 | A | | 10/1998 | Soczka | |
| 6,219,946 | B1 | | 4/2001 | Soczka | |
| 6,467,202 | B1 | | 10/2002 | Brown, Jr. | |
| 6,591,521 | B2 | | 7/2003 | Brown | |
| 7,096,610 | B1 | | 8/2006 | Gilmore | |
| 8,136,272 | B2 | | 3/2012 | Hren et al. | |
| 8,590,180 | B2 | | 11/2013 | Hren et al. | |
| 9,890,515 | B2 | | 2/2018 | Gross et al. | |
| 9,915,053 | B2 | | 3/2018 | Gross et al. | |
| 2006/0208496 | A1 | | 9/2006 | Kondratuk et al. | |
| 2011/0146114 | A1 | | 6/2011 | Hren et al. | |
| 2012/0192465 | A1 | | 8/2012 | Opazo | |
| 2013/0192099 | A1 | | 8/2013 | Gilmore et al. | |
| 2013/0192100 | A1 | | 8/2013 | Gilmore et al. | |
| 2014/0007469 | A1 | | 1/2014 | Gross et al. | |
| 2014/0059901 | A1 | | 3/2014 | Nicoson et al. | |
| 2014/0225383 | A1 | | 8/2014 | Simmonds et al. | |
| 2015/0159341 | A1 | | 6/2015 | Gross et al. | |

OTHER PUBLICATIONS

Australian Patent Office Examination Report for Application No. 2020223775 dated Dec. 13, 2022 (6 pages).

Russian Patent Office Action and Search Report for Application No. 2018127839/03 dated Dec. 17, 2021 (18 pages, including English translation).

Australian Examination Report for Application No. 2023201363 dated Jun. 5, 2024 (6 pages).

* cited by examiner

DIPPER DOOR AND DIPPER DOOR TRIP ASSEMBLY

CROSS-REFERENCE TO RELATED APPLICATIONS

This application is a continuation of U.S. application Ser. No. 15/877,049, filed Jan. 22, 2018, which is a continuation of U.S. application Ser. No. 14/497,003, filed Sep. 25, 2014, and claims priority to U.S. Provisional Application No. 61/883,982, filed Sep. 27, 2013, and to U.S. Provisional Application No. 61/968,030, filed Mar. 20, 2014, the entire contents of each of which are incorporated herein by reference.

FIELD OF THE INVENTION

The present invention relates to the field of mining machines. Specifically, the present invention relates to a dipper door and a dipper door trip assembly on a mining machine, such as a rope shovel.

Industrial mining machines, such as electric rope or power shovels, draglines, etc., are used to execute digging operations to remove material from a bank of a mine. On a conventional rope shovel, a dipper is attached to a handle, and the dipper is supported by a cable, or rope, that passes over a boom sheave. The rope is secured to a bail that is pivotably coupled to the dipper. The handle is moved along a saddle block to maneuver a position of the dipper. During a hoist phase, the rope is reeled in by a winch in a base of the machine, lifting the dipper upward through the bank and liberating the material to be dug. To release the material disposed within the dipper, a dipper door is pivotally coupled to the dipper. When not latched to the dipper, the dipper door pivots away from a bottom of the dipper, thereby freeing the material out through a bottom of the dipper.

SUMMARY

In accordance with one construction, a mining shovel includes a boom, a handle coupled to the boom, a dipper coupled to the handle, and a dipper door pivotally coupled to the dipper. The mining shovel also includes a dipper door trip assembly including a trip motor coupled to the boom, a trip drum coupled to the handle, a linkage assembly coupled to the dipper door, a first actuation element extending directly from the trip motor to the trip drum, and a second actuation element extending directly from the trip drum to the linkage assembly.

In accordance with another construction, a dipper door trip assembly includes a trip motor, an actuation element coupled to the trip motor, and a linkage assembly coupled to the actuation element. The linkage assembly includes a lever arm coupled to the actuation element, a rod coupled to the lever arm about a first joint, a latch lever bar coupled to the rod about a second joint, and a latch bar coupled to the latch lever bar, wherein activation of the trip motor causes generally linear movement of the latch bar and latch bar insert, and wherein the first and second joints permit the rod to move in multiple degrees of freedom.

In accordance with another construction, a dipper door includes a bottom panel having a plurality of openings that open to an interior cavity inside the dipper door, a top panel, and a plurality of ribs extending between the bottom panel and the top panel.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
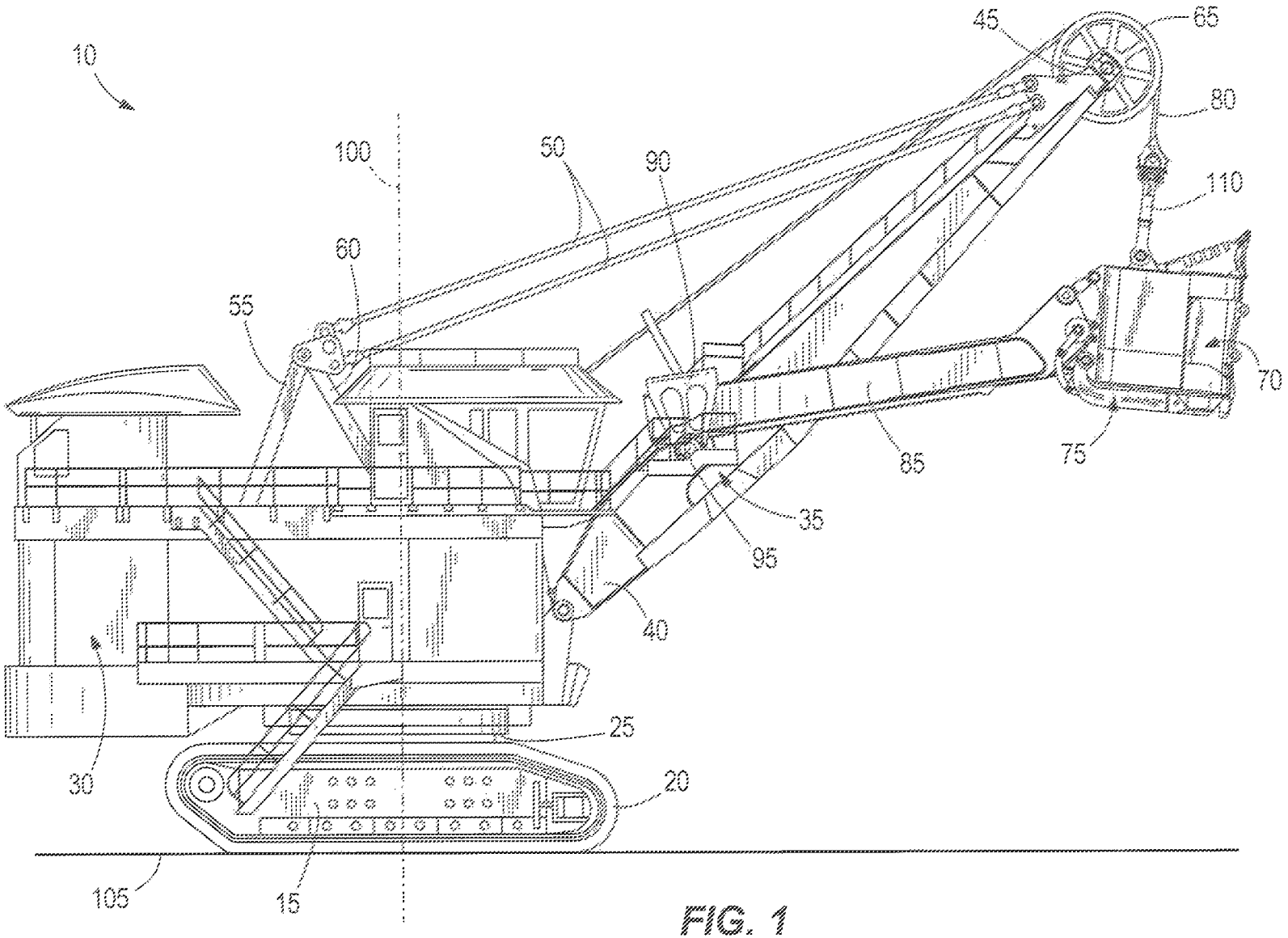
FIG. 1 is a perspective view of a mining shovel.

FIG. 1 illustrates a power shovel 10. The shovel 10 includes a mobile base 15, drive tracks 20, a turntable 25, a revolving frame 30, a boom 35, a lower end 40 of the boom 35 (also called a boom foot), an upper end 45 of the boom 35 (also called a boom point), tension cables 50, a gantry tension member 55, a gantry compression member 60, a sheave 65 rotatably mounted on the upper end 45 of the boom 35, a dipper 70, a dipper door 75 pivotally coupled to the dipper 70, a hoist rope 80, a winch drum (not shown), a dipper handle 85, a saddle block 90, a shipper shaft 95, and a transmission unit (also called a crowd drive, not shown). The rotational structure 25 allows rotation of the upper frame 30 relative to the lower base 15. The turntable 25 defines a rotational axis 100 of the shovel 10. The rotational axis 100 is perpendicular to a plane 105 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the revolving frame 30 by the tension cables 50, which are anchored to the gantry tension member 55 and the gantry compression member 60. The gantry compression member 60 is mounted on the revolving frame 30.

The dipper 70 is suspended from the boom 35 by the hoist rope 80. The hoist rope 80 is wrapped over the sheave 65 and attached to the dipper 70 at a bail 110. The hoist rope 80 is anchored to the winch drum (not shown) of the revolving frame 30. The winch drum is driven by at least one electric motor (not shown) that incorporates a transmission unit (not shown). As the winch drum rotates, the hoist rope 80 is paid out to lower the dipper 70 or pulled in to raise the dipper 70. The dipper handle 85 is also coupled to the dipper 70. The dipper handle 85 is slidably supported in the saddle block 90, and the saddle block 90 is pivotally mounted to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the hoist drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

Figure 2:
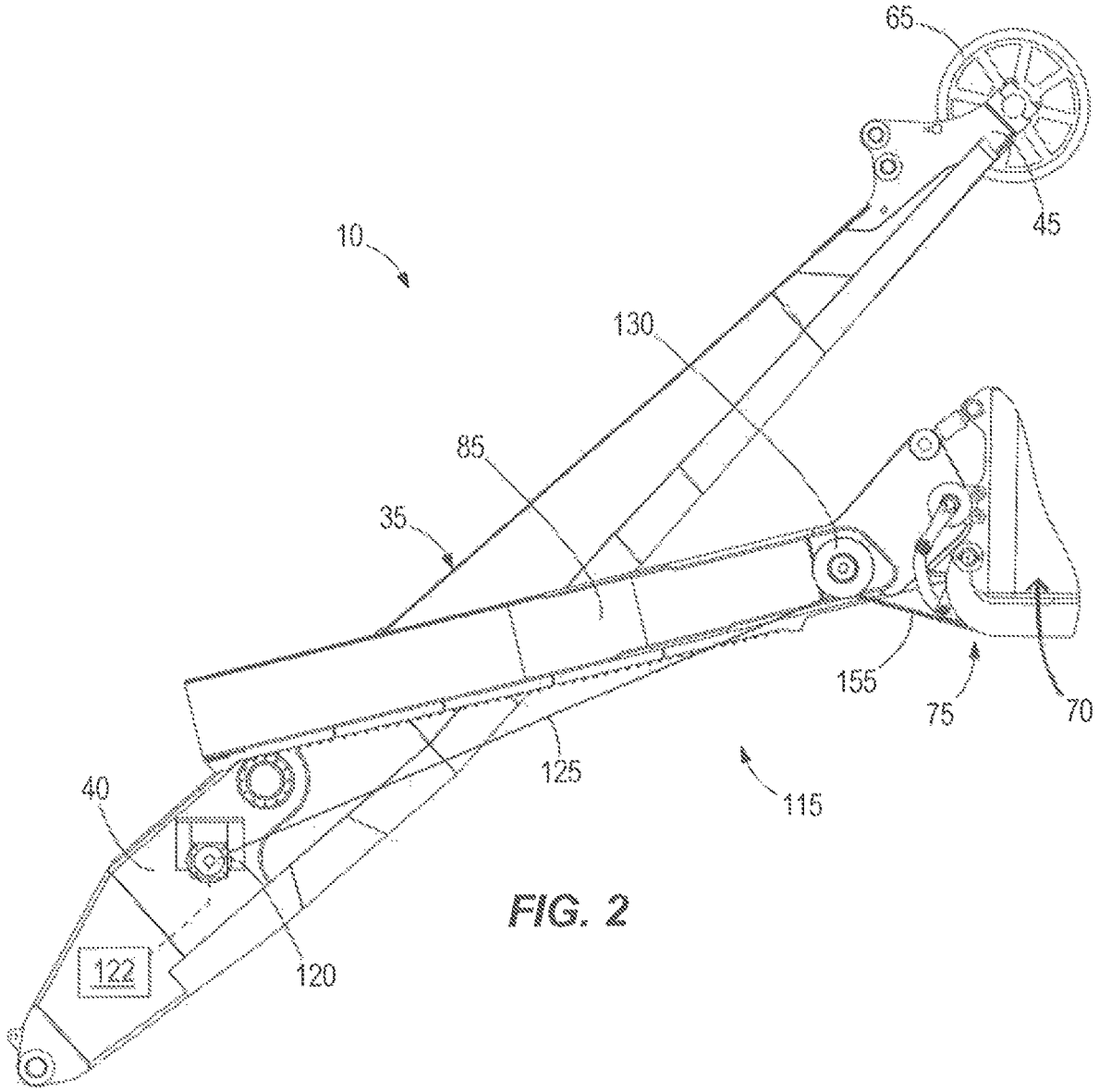
FIG. 2 is a partial side view of a boom, handle, dipper, and dipper door of the mining shovel of FIG. 1, as well as a dipper door trip assembly coupled to the shovel.

FIG. 2 illustrates a dipper door trip assembly 115 for the shovel 10. The dipper door trip assembly 115 releases the dipper door 75 from the dipper 70 and allows the dipper door 75 to pivot away from a bottom of the dipper 70. Although the dipper door trip assembly 115 is described in the context of the power shovel 10, the dipper door trip assembly 115 can be applied to, performed by, or used in conjunction with a variety of industrial machines (e.g., draglines, shovels, tractors, etc.).

With reference to FIG. 2, the dipper door trip assembly 115 includes a trip motor 120 disposed along the lower end 40 of the boom 35. The trip motor 120 is powered by an electrical power source 122 (illustrated schematically) with its own motor controller. In some constructions the trip motor 120 is driven in response to control signals sent from a remotely located controller (e.g., a controller on the frame 30).

Figure 3:
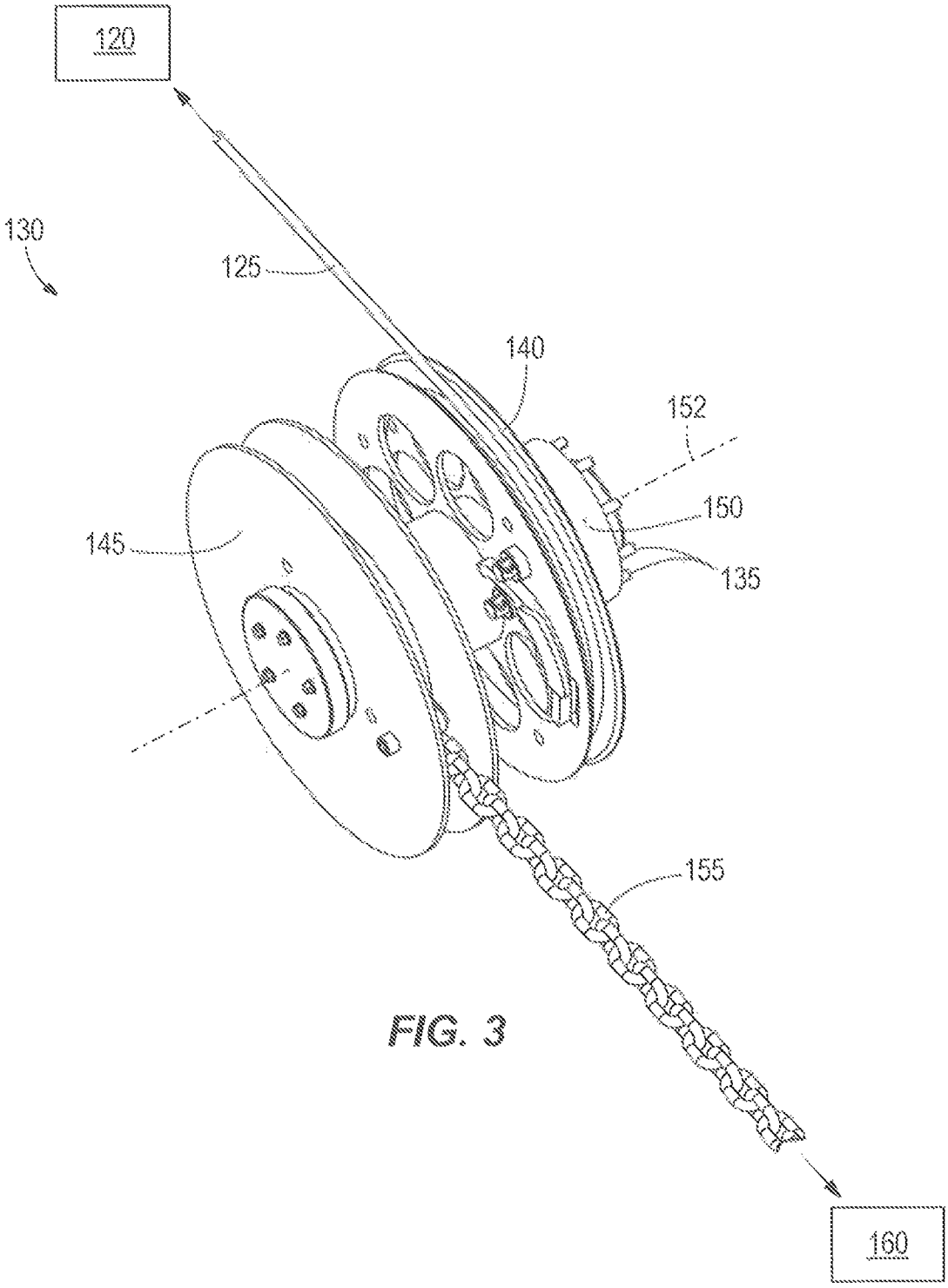
FIG. 3 is perspective view of a trip drum and actuation elements of the dipper door trip assembly.

With reference to FIGS. 2 and 3, a first actuation element 125 (e.g., a wire rope, belt, or chain) is coupled to and extends directly from the trip motor 120 to a trip drum 130. The trip drum 130 is releasably coupled to the dipper handle 85 with at least one mounting structure 135, (e.g., a set of bolts and nuts), so that the trip drum 130 may be removed for repair or replaced with a different trip drum 130.

As illustrated in FIG. 3, the trip drum 130 includes a first drum portion 140 and a second drum portion 145, both aligned along a common shaft 150 defining an axis of rotation 152. The drum portion 140 is larger (e.g., in diameter) than the drum portion 145, although in some constructions the drum portion 145 is larger than the drum portion 140. The actuation element 125 is coupled to the drum portion 140 (e.g., fixed at one end of the actuation element 125 to the drum portion 140), so that as the trip motor 120 turns, the actuation element 125 is either wound around or unwound from the drum portion 140.

With reference to FIGS. 2 and 3, a second actuation element 155 (e.g., a wire rope, belt, or chain) is coupled to and extends from the drum portion 145 directly to a linkage assembly 160. The actuation element 155 is coupled to the drum portion 145 (e.g., fixed at one end of the actuation element 155 to the drum portion 145), so that as the trip motor 120 turns, the actuation element 155 is either wound around or unwound from the drum portion 145.

Because of the difference in size of the drum portions 140, 145, the trip drum 130 generates a mechanical advantage equivalent to the ratio of the diameter of the drum portion 140 to the diameter of the drum portion 145. In some constructions, the ratio of the diameter of the drum portion 140 to the diameter of the drum portion 145 is greater than approximately 2.0. In some constructions, the ratio is between approximately 2.0 and 4.0. In some constructions, the ratio is greater than 3.0. Other constructions include different ranges and values.

The trip drum 130 advantageously removes the need for multiple sheaves, pulleys, or other structures to route the actuation elements 125, 155 along the shovel 10. Rather, as described above, the first actuation element 125 is routed directly from the trip motor 120 to the trip drum 130, and the second actuation element 155 is routed directly from the trip drum 130 to the linkage assembly 160.

The trip drum 130 also advantageously provides a reduction in whiplash effect generated during movement of the shovel 10. Because the first and second actuation elements 125, 155 are kept separate and are not directly coupled to one another, and because the trip drum 130 is heavy (e.g., at least 500 lbs.), any whiplash in the actuation element 125 (e.g., generated by rapid movement or swaying of the shovel 10) will not substantially affect the movement and functionality of the actuation element 155. Rather, a significant amount of inertia must be overcome in the trip drum 130 before the second actuation element 155 is affected negatively by any whiplash occurring in the actuation element 125. In some constructions, the trip drum 130 also includes one or more dampers (e.g., linear or rotational) or friction disk brakes that further help to dampen any whiplash occurring in the actuation element 125.

Figure 4:
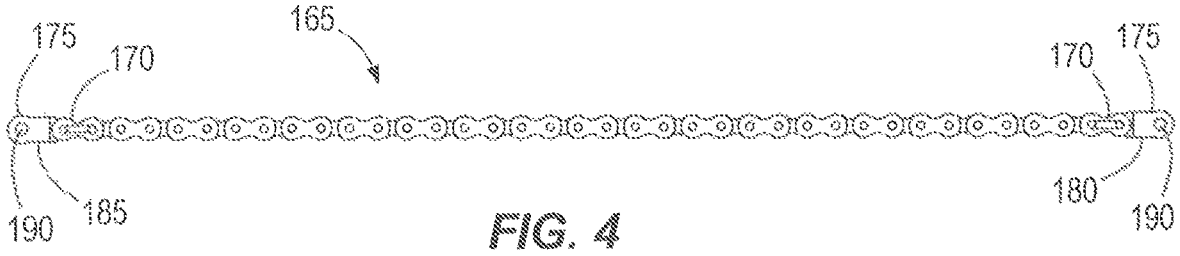
FIG. 4 is a side view of an actuation element according to another construction.
Figure 5:
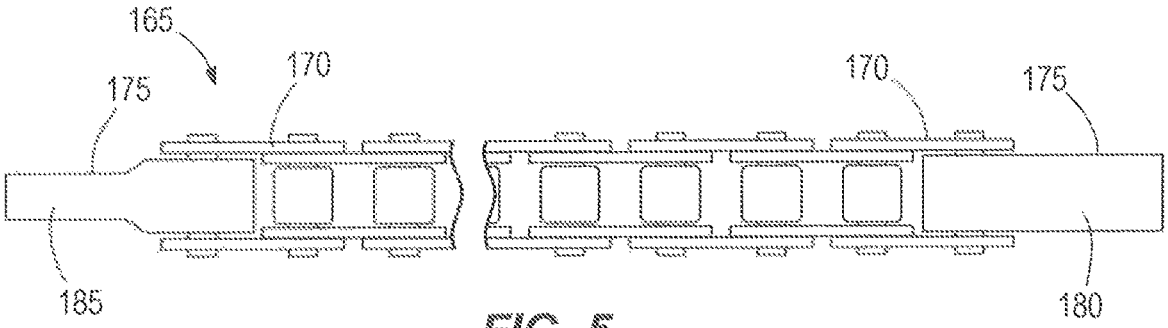
FIG. 5 is a top view of the actuation element of FIG. 4.
Figure 6:
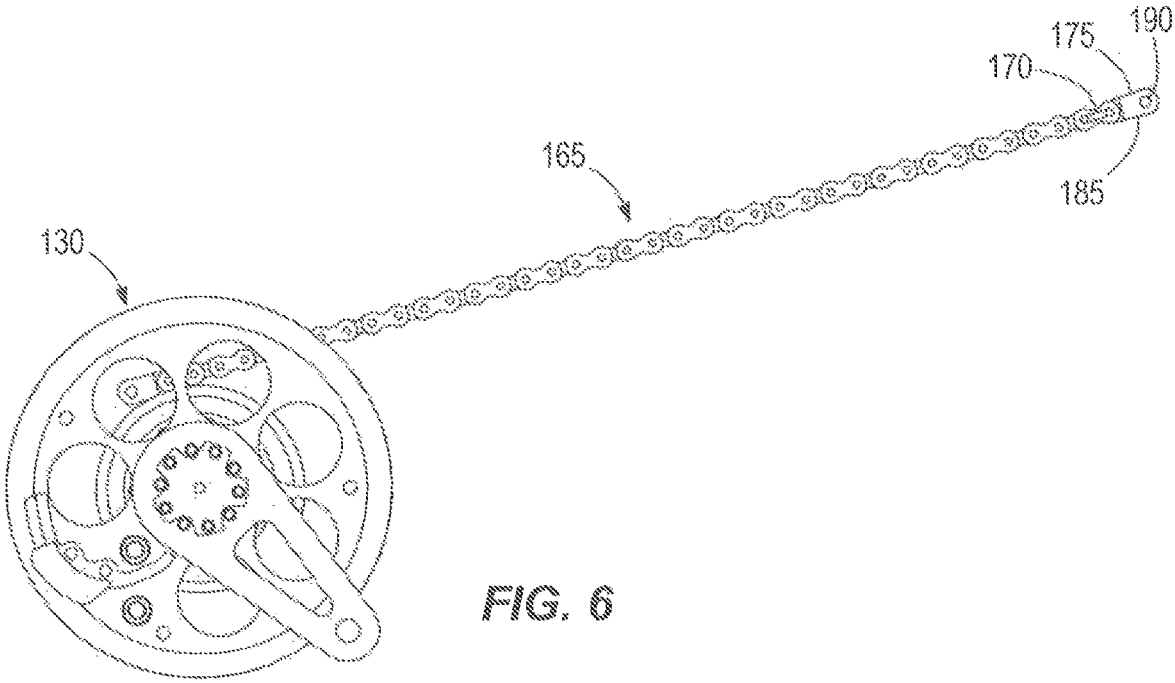
FIG. 6 is a side view of the actuation element of FIG. 4, coupled to the trip drum.
Figure 7:
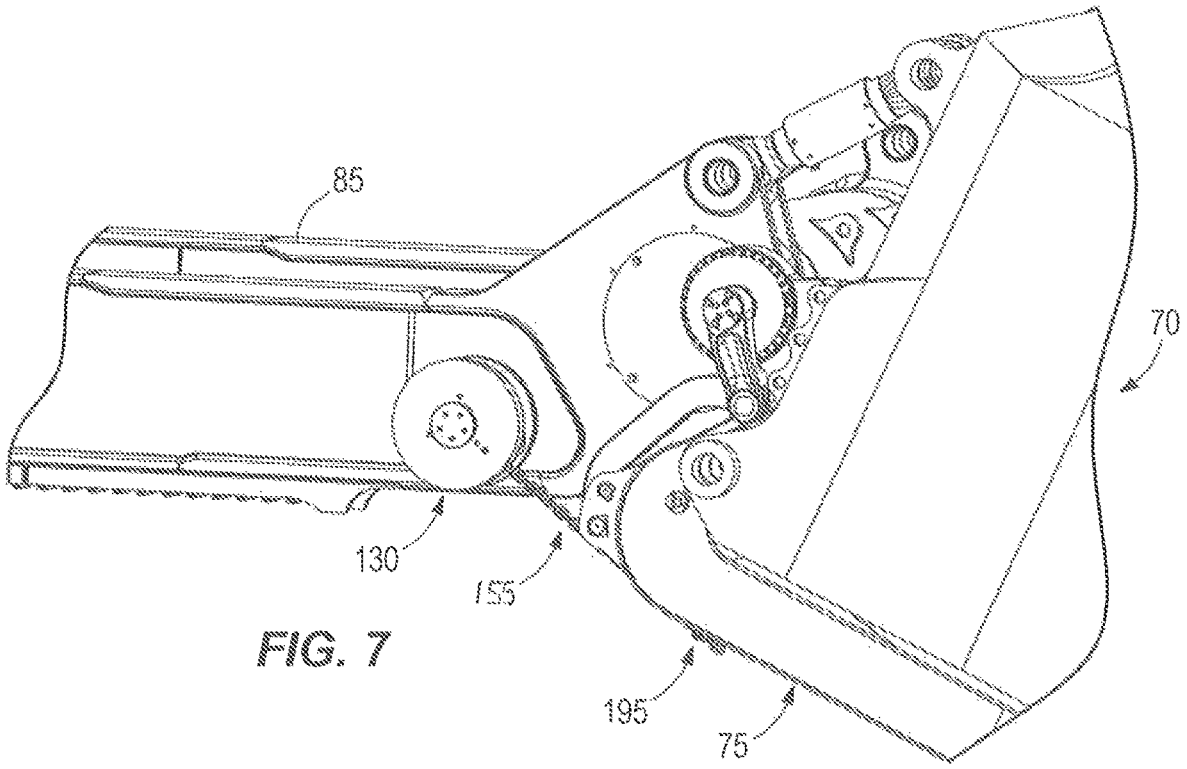
FIGS. 7 and 8 are perspective views of the trip drum and actuation element of FIG. 4, coupled to the linkage assembly.
Figure 8:
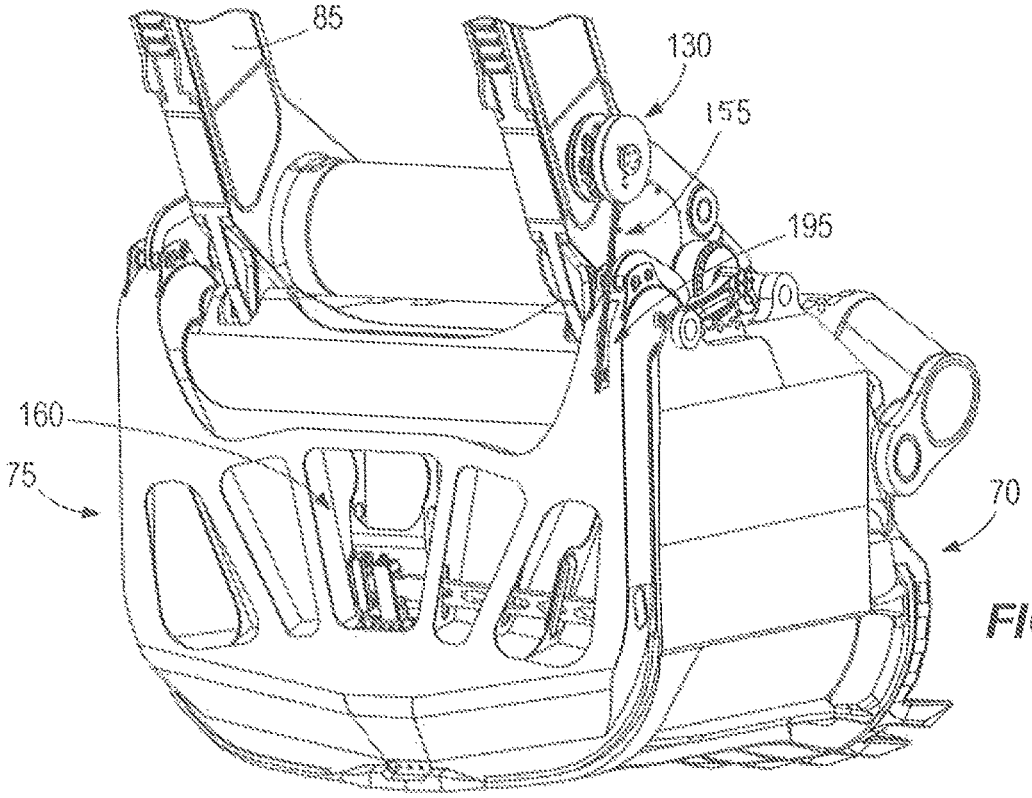

FIGS. 4-6 illustrate an actuation element 165 according to another construction. The actuation element 165 is a roller chain that allows for flat wind up and flat contact surface between the actuation element 165 and the drum 130, similar to a sprocket, without chain twisting that can often cause wear. The life of the actuation element 165 is increased over traditional link chains (e.g., such as the actuation element 155 illustrated in FIG. 3), particularly at the point where the actuation element 165 couples to the linkage assembly 160, as well as where the actuation element 165 wraps around the drum 130. The actuation element 165 provides improved wear characteristics for motion in the direction of rolling the chain onto the drum 130. Reduction of wear and improvement of life at these points eliminates the need to constantly replace the actuation element 165, which can occur every two weeks or sooner when a standard link chain is used as an actuation element. Less frequent replacement of the actuation element reduces the maintenance cost associated with the shovel 10. In some constructions, the actuation element 165 lasts as long as nine to twelve months.

With reference to FIGS. 4 and 5, in some constructions the actuation element 165 includes high strength end links 170, as well as connectors 175 coupled to the end links 170. The connectors 175 couple a first end 180 of the actuation element 165 to the drum 130 and a second end 185 of the actuation element 165 to the linkage assembly 160. The connectors 175 include apertures 190 to couple the actuation element 165 to a pin or other structure on the drum 130 and the linkage assembly 160. The end links 170 and the connectors 175 provide longer wear life where the actuation element 165 is coupled to the drum 130 and to the linkage assembly 160. In some constructions, one or more of the end links 170 and the connectors 175 take all, or substantially all, of the wear in the actuation element 165 during use.

In some constructions the actuation element 165 is coupled to both a length of standard link chain and to the linkage assembly 160 in order to remove chain twist that causes wear at the drum 130. In other constructions the actuation element 165 is coupled between two drums 130, or between a drum 130 and another lever or linkage assembly in a mining machine other than the linkage assembly 160.

With reference to FIGS. 7-12, the linkage assembly 160 includes a lever arm 195 configured to be coupled to the actuation element 155 (or 165). The lever arm 165 is disposed at least partially within the dipper door 75, and is pivotally coupled to the dipper door 75 about a pivot structure 200, such as a bolt or rod (FIGS. 11 and 12) disposed in the dipper door 75. As the actuation element 155 is moved by the trip motor 120, the lever arm 195 is caused to pivot about the pivot structure 200. Other constructions include different locations for the lever arm 195 than that illustrated, as well as different shapes and sizes. In some constructions the lever arm 195 is disposed substantially entirely within or entirely outside of the dipper door 75.

With continued reference to FIGS. 9-12, the linkage assembly 160 includes a further pivot structure 205, such as a bolt or rod (FIGS. 11 and 12) coupled to the lever arm 165. The pivot structure 205 receives an end of the actuation element 155 (e.g., receives a link of a chain of the actuation element 155, or the connector 175 in the case of the actuation element 165), allowing the actuation element 155 to pivot relative to the lever arm 195 as the actuation element 155 is moved by the trip motor 120. The pivot structure 205 is sized and shaped to absorb a substantial amount of stress generated by the pulling force of the actuation element 155 on the lever arm 195 as the actuation element 155 is moved by the trip motor 120. The pivot structure 205 is easily removable from the lever arm 195 to be repaired or replaced.

Figure 10:
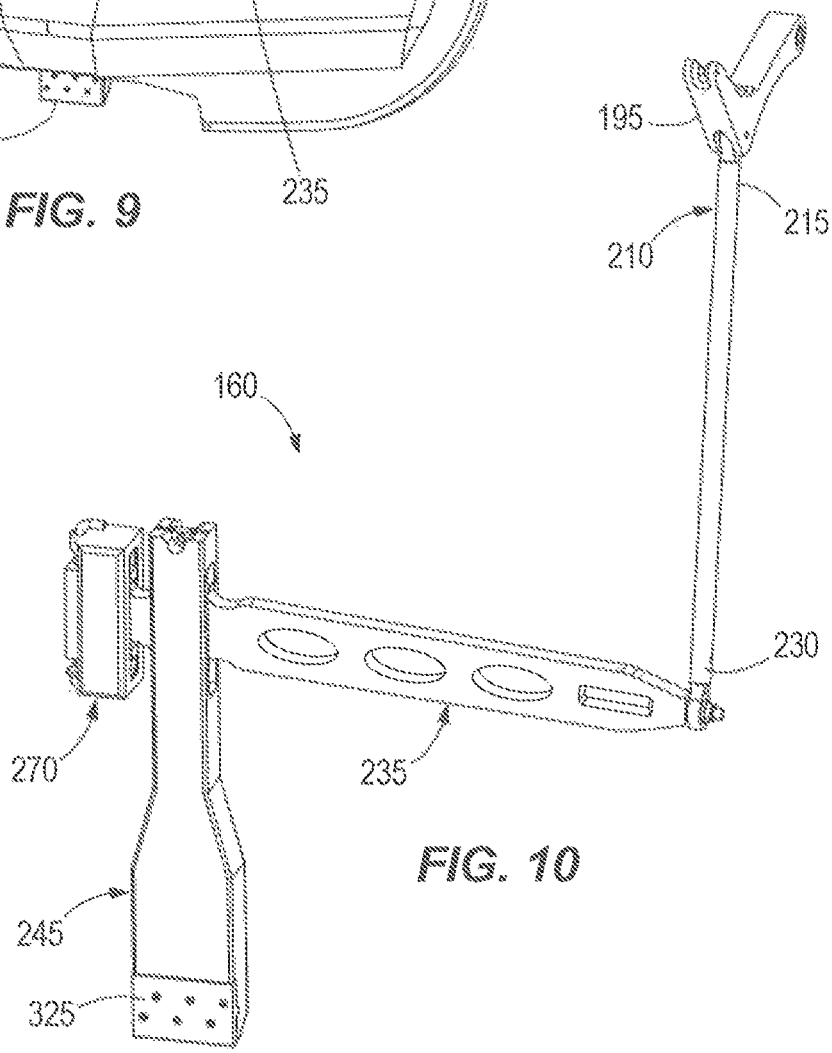
FIG. 10 is a perspective view of the linkage assembly, with the dipper door removed.
Figure 11:
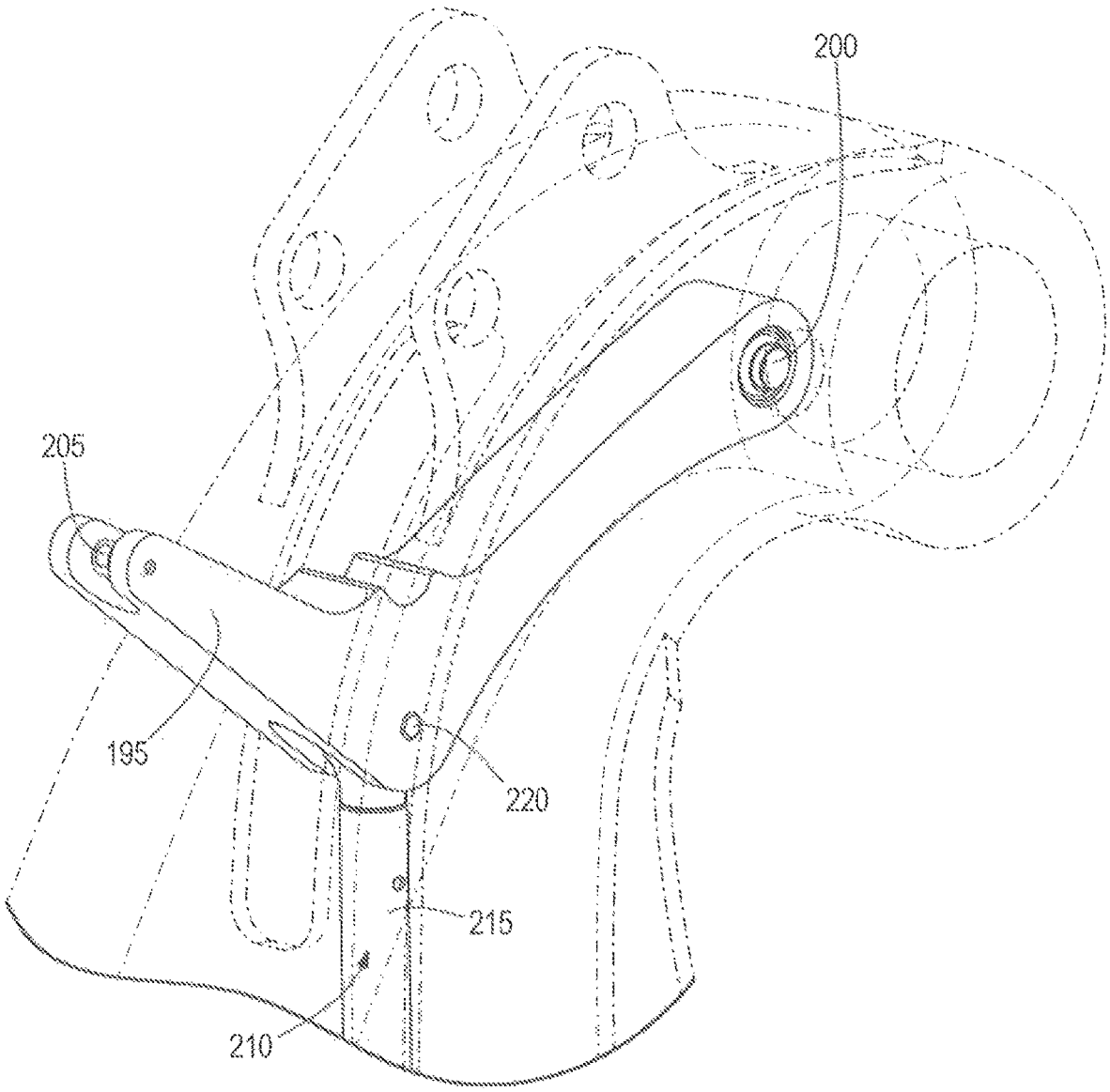
FIG. 11 is an enlarged view of a lever arm of the linkage assembly partially disposed within the dipper door.
Figure 12:
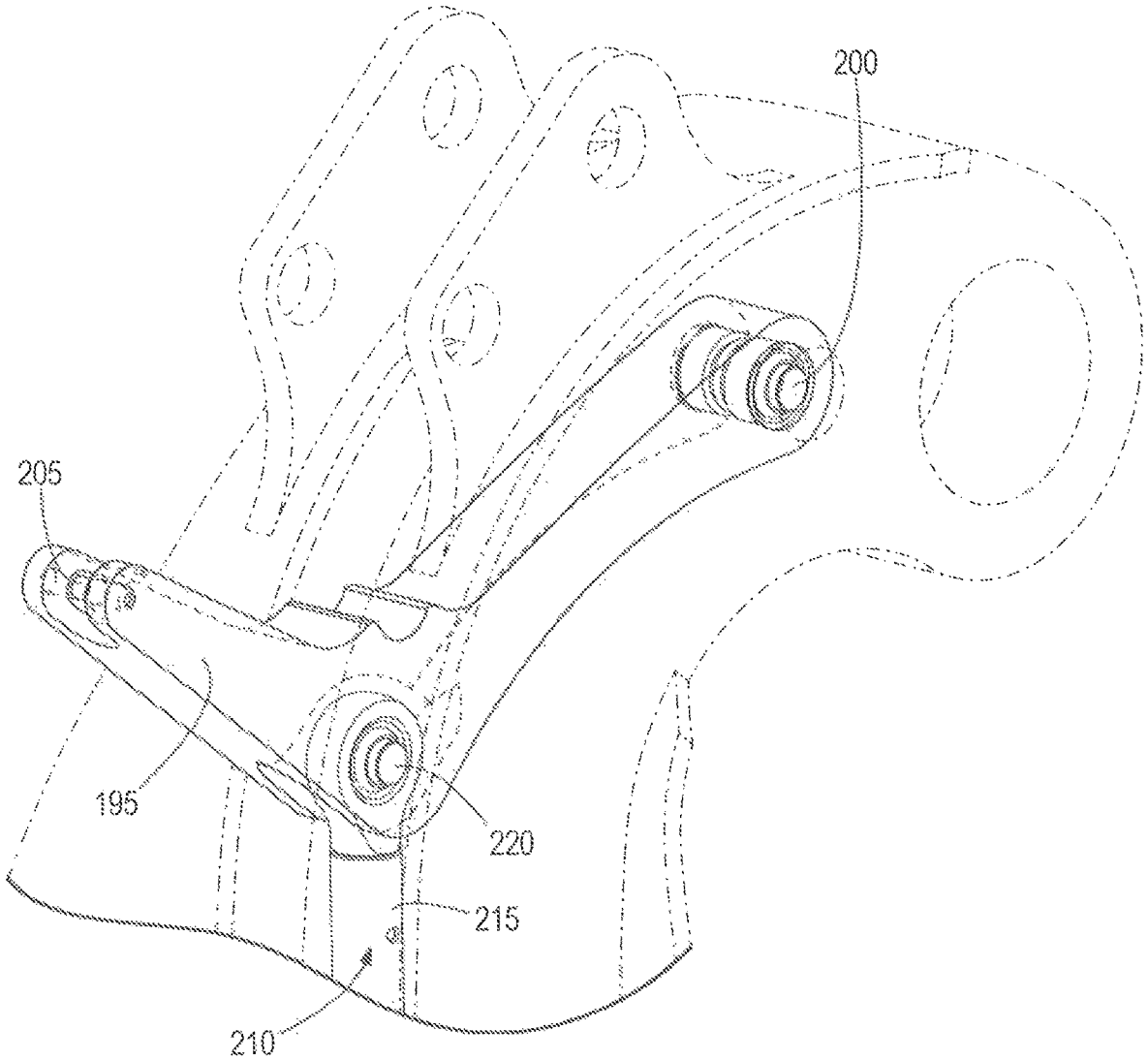
FIGS. 12 and 13 are enlarged views of a joint between the lever arm and a first end of a rod in the linkage assembly.
Figure 13:
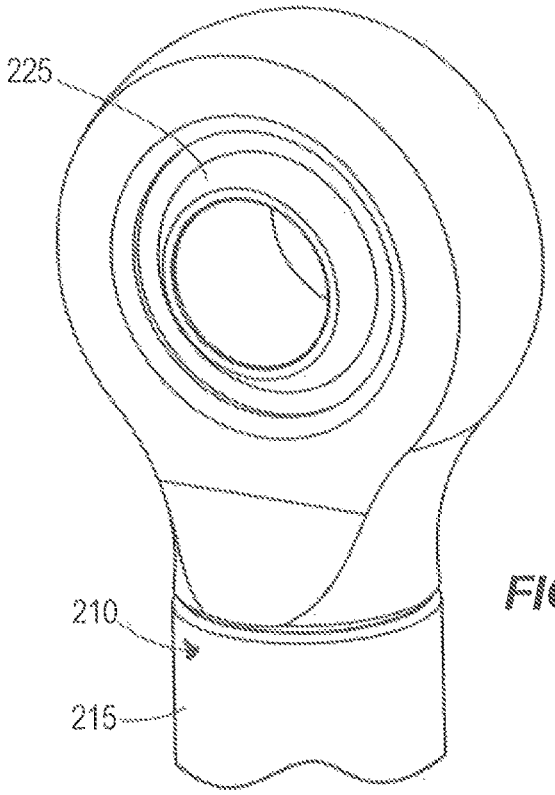

With reference to FIGS. 10-14, the linkage assembly 160 further includes a rod 210 pivotally coupled to the lever arm 195. The rod 210 includes a first end 215 that is received at least partially within the lever arm 195 and pivots about a pivot structure 220 (including, e.g., a bolt or rod as illustrated in FIGS. 11 and 12) coupled to the lever arm 195, such that the rod 210 is able to pivot relative to the lever arm 195. As illustrated in FIG. 13, the rod 210 also includes a spherical bearing or bushing 225 within the first end 215, thereby creating a spherical joint between the rod 210 and the lever arm 195 that permits freedom of movement and rotation of the rod 210 about multiple axes relative to the lever arm 195. Other constructions include different types of joints between the rod 210 and the lever arm 195 (e.g., a ball joint, etc.).

Figure 14:
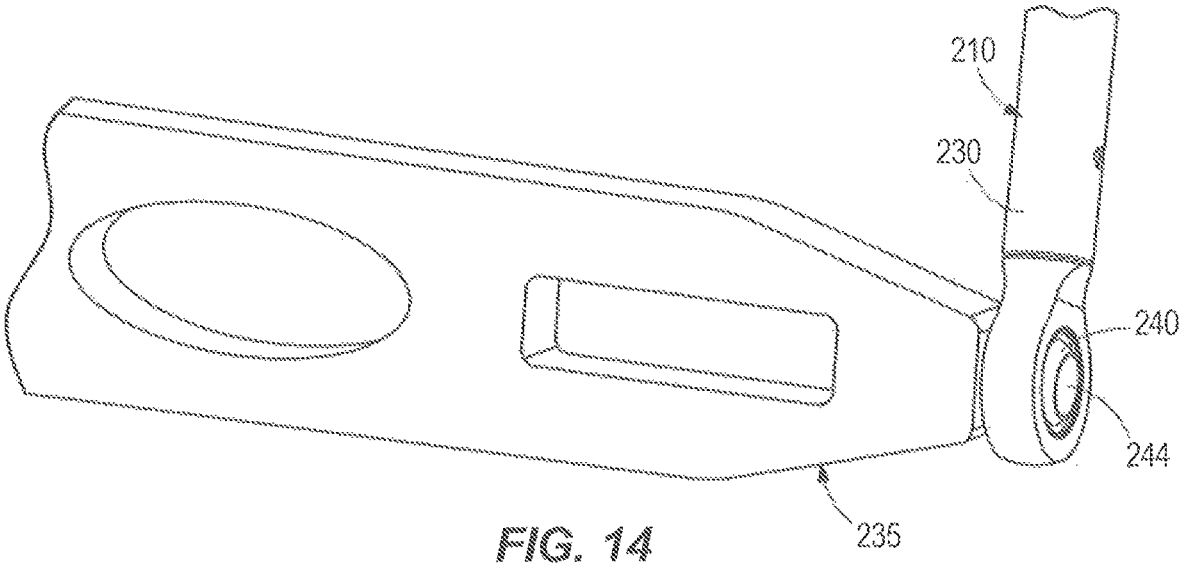
FIG. 14 is an enlarged view of a joint between a second end of the rod and a latch lever bar in the linkage assembly.

With reference to FIGS. 10 and 14, the rod 210 further includes a second end 230 that is coupled to a latch lever bar 235 of the linkage assembly 160. As with the first end 215, the second end 230 also includes a spherical bearing or bushing 240 that receives an end 244 of the latch lever bar 235, thereby creating a spherical joint between the rod 210 and the latch lever bar 235 that permits freedom of movement and rotation of the rod 210 about multiple axes relative to the latch lever bar 235. Other constructions include a different type of joint between the rod 210 and the latch lever bar 235 (e.g., a ball joint, etc.).

The use of spherical or ball joints between the rod 210 and both the lever arm 195 and the latch lever bar 235 permits deflections and adjustment of the rod 210 within the linkage assembly 160 during activation of the trip motor 120. This freedom to move and deflect inhibits damage to the components of the linkage assembly 160. While the illustrated construction utilizes spherical bearings or bushings 225, 240 on the ends of the rod 210 to receive ends of the lever arm 195 and the latch lever bar 234, in other constructions one or more of the spherical bearings or bushings are instead disposed on the lever arm 195 and/or the latch lever bar 235, so as to receive ends of the rod 210.

Figure 15:
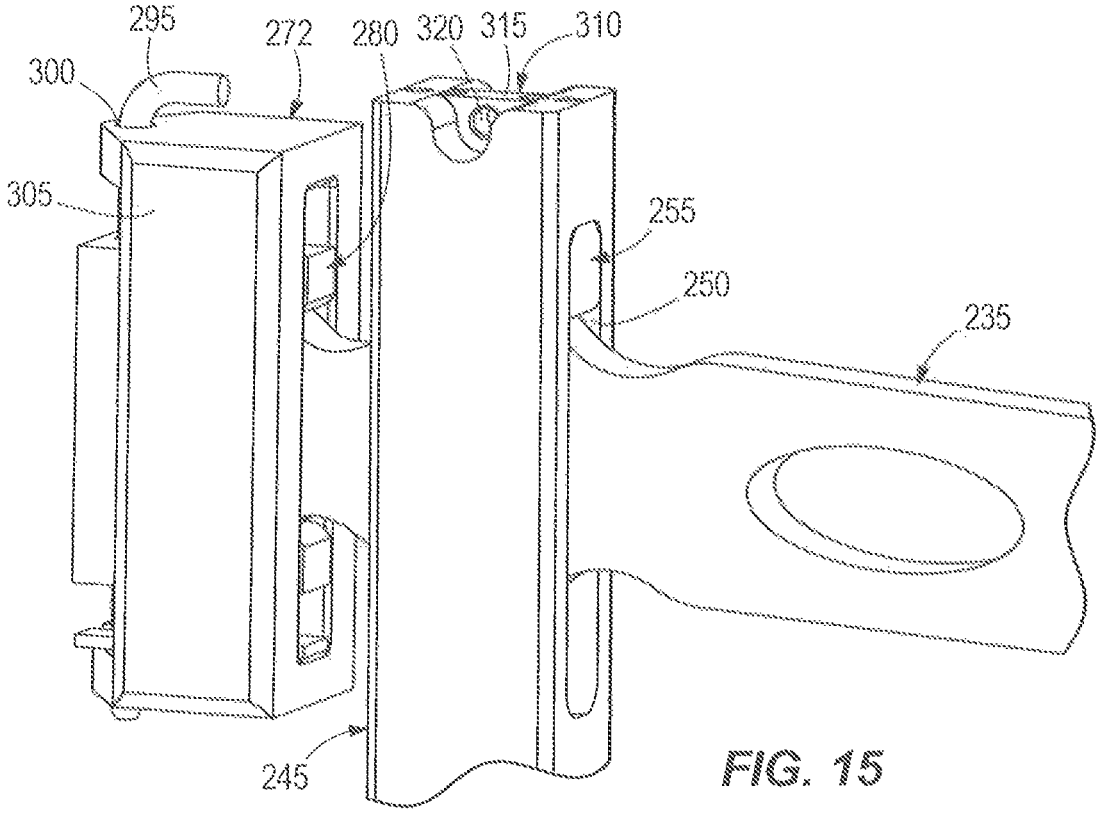
FIG. 15 is an enlarged view of a joint between the latch lever bar and a latch bar in the linkage assembly.
Figure 16:
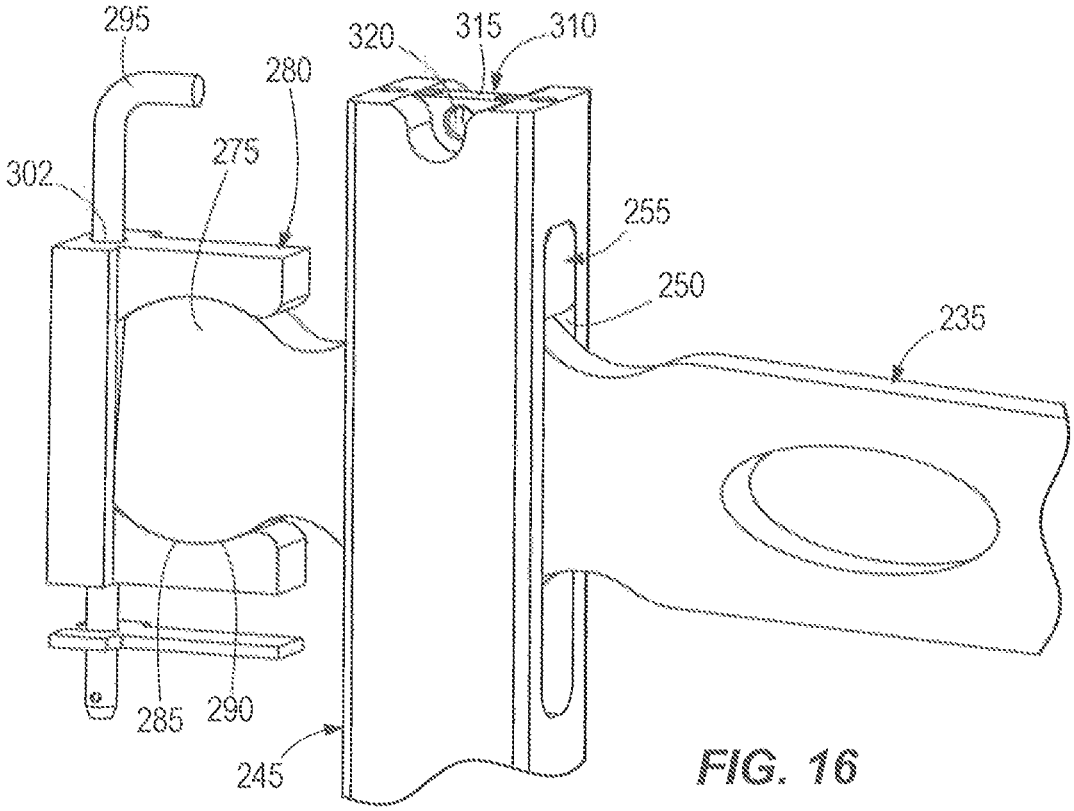
FIG. 16 is a view of the joint of FIG. 15, with a housing element removed, illustrating an end of the latch lever bar.
Figure 17:
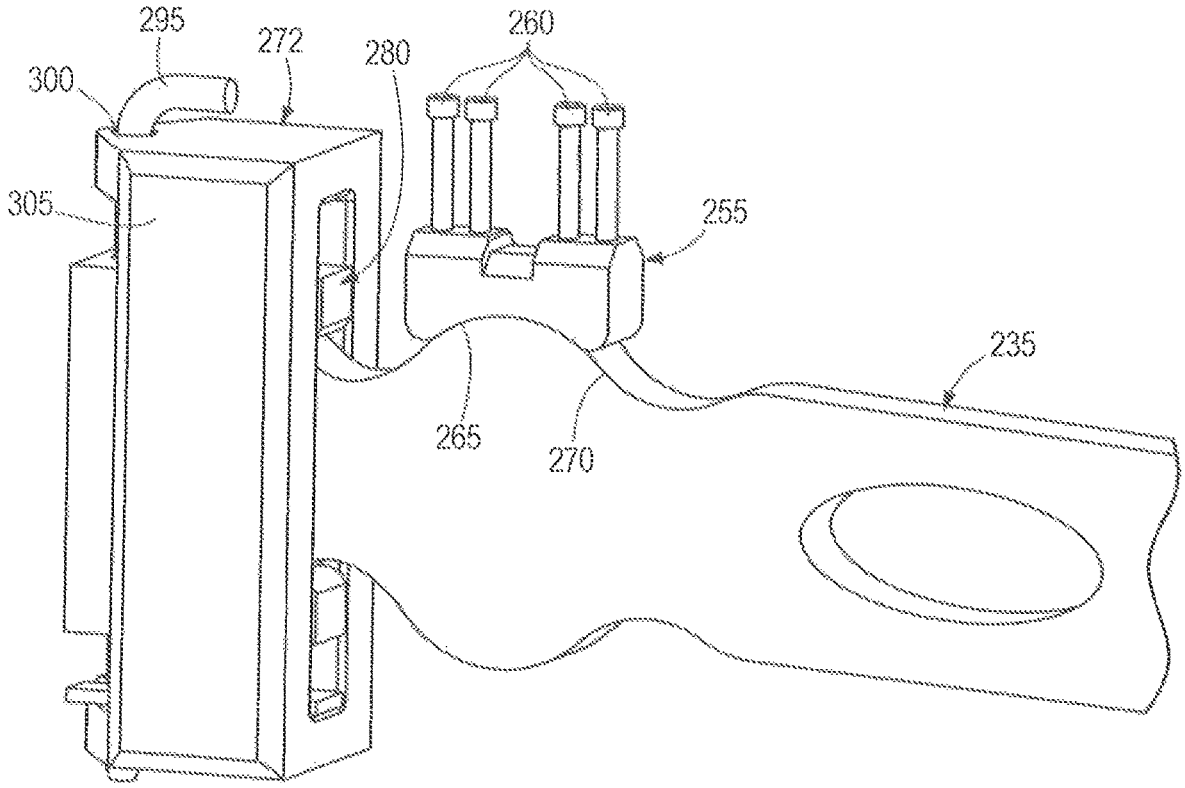
FIG. 17 is a view of the joint of FIG. 15, with the latch bar removed, illustrating an insert.

With reference to FIGS. 10 and 15-17, the linkage assembly 160 further includes a latch bar 245 that is coupled to and receives the latch lever bar 235. With reference to FIGS. 15-17, the latch lever bar 235 passes through an opening 250 in the latch bar 245. An insert 255 (e.g., metal) is disposed within an upper portion of the opening 250. As illustrated in FIG. 17, the insert 255 is coupled to the latch bar 245 with fasteners 260. The insert 255 has a curved, contoured lower surface 265 that substantially matches a curved, contoured upper surface 270 on the latch lever bar 235. The surfaces 265, 270 act as bearing surfaces to permit some rotation and relative movement in at least one degree of freedom between the insert 255 and the latch lever bar 234, thereby inhibiting wear and unwanted stress from damaging the linkage assembly 160. The insert 255 prevents or inhibits wear of the latch bar 245, and is easily removable and replaceable. In some constructions no insert 255 is provided. Rather, an inner surface of the latch bar 245 inside the opening 250 has a curved, contoured surface similar to the surface 265.

With continued reference to FIGS. 15 and 16, the linkage assembly 160 further includes a housing and pin assembly 272 that receives an end 275 of the latch lever bar 235 and permits movement of the end 275 in at least one degree of freedom (e.g., linearly). In the illustrated construction the housing and pin assembly 272 includes a carrier 280 that is shaped to receive the end 275. The carrier 280 includes a curved, contoured surface 285 (FIG. 16) that substantially matches a curved, contoured surface 290 on the latch lever bar 235. The surface 285 retains the end 275 within the housing 280. The housing and pin assembly 272 further includes a pin 295 that extends through an aperture 300 in an outer housing 305 and an aperture 302 in the carrier 280. The carrier 280 is able to move (e.g., slide) along the pin 295 within the outer housing 305, carrying the end 275 of the latch lever bar 235. In some constructions the pin 295 and/or outer housing 305 is coupled to (e.g., affixed) the dipper door 75, such that when the latch lever bar 235 is moved by rod 210, the carrier 280 and the end 275 of the latch lever bar 235 are moved along a linear direction within the housing 305, causing the latch bar 245 also to generally move along a linear direction.

Figure 17A:
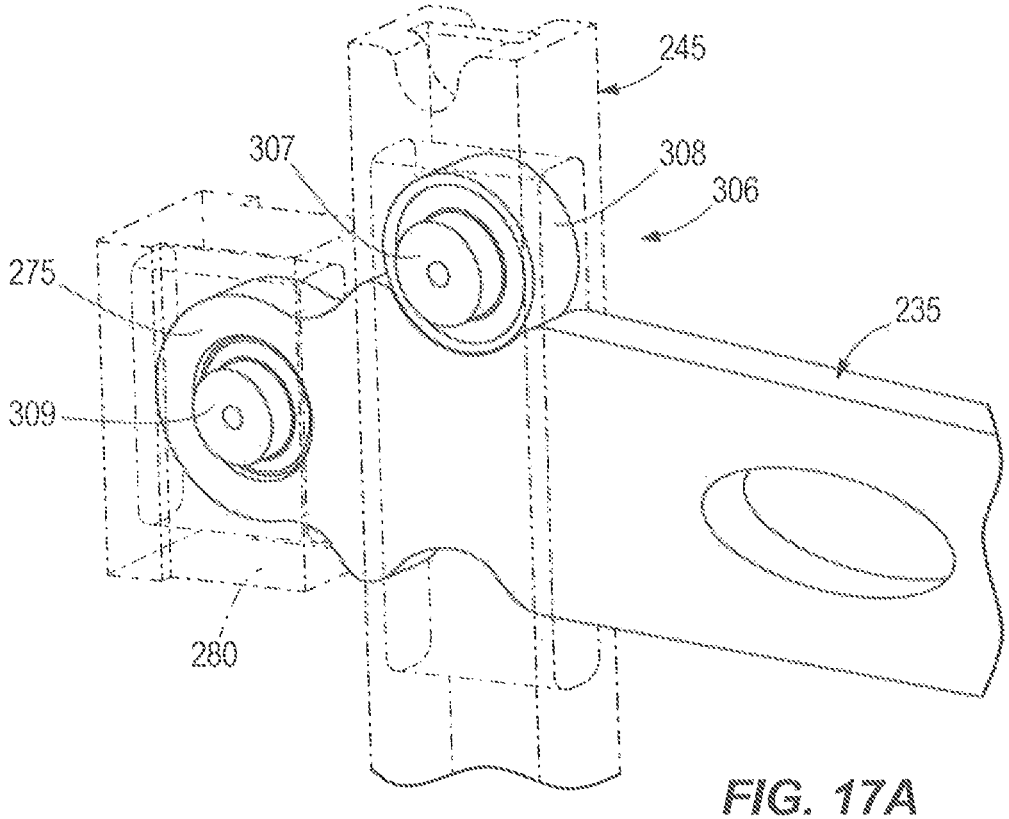
FIGS. 17A and 17B illustrate an embodiment of a cup roller assembly and latch a bar insert to be used with the linkage assembly.

In some constructions other structures are used to create one or more bearing surfaces for the latch lever bar 235, and to facilitate movement of the latch lever bar 235 without damaging the latch bar 245. For example, with reference to FIGS. 17A and 17B, in some constructions a cup roller assembly 306 is used, which includes a pin 307 and a roller 308 that rotates about the pin 307. The pin 307 and the roller 308 are both coupled to and disposed at least partially within the latch bar 245. The roller 308 engages a curved, contoured upper surface of the latch lever bar 235. In the embodiment illustrated in FIGS. 17A and 17B, the latch lever bar 235 further includes a second roller 309 that is coupled to the carrier 280 and to the latch lever bar 235 to facilitate rotational movement of the end 275 of the latch lever bar 235.

With reference to FIGS. 15 and 16, the latch bar 245 includes an engagement portion 310 that facilitates easy gripping and/or removal of the latch bar 245 from the linkage assembly 160 to repair or replace the latch bar 245. In the illustrated construction the engagement portion 310 is a recessed flange 315 with an aperture 320 that may receive a pin or other lifting structure that engages the engagement portion 310. In other constructions the engagement portion 310 is a protruding flange with an aperture, or is another structure that allows easy gripping and removal of the latch bar 245 when desired.

Figure 9:
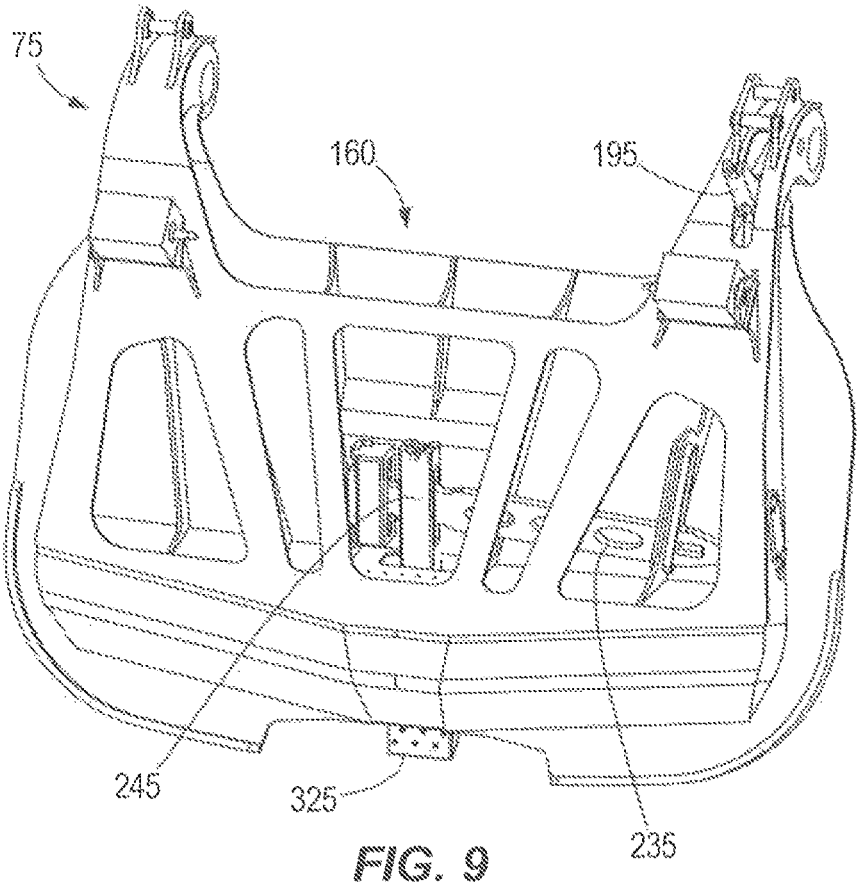
FIG. 9 is a perspective view of the dipper door, and a linkage assembly of the dipper door trip assembly partially disposed within the dipper door.

With reference to FIGS. 9 and 10, the linkage assembly 160 further includes a latch bar insert 325 disposed at an end of the latch bar 245. In some constructions the latch bar insert 325 is formed as part of the latch bar 245. The latch bar insert 325 extends from the housing dipper door 75, and is moved along with the latch bar 215 when the trip motor 120 is activated and the actuation element 155 is moved. In the illustrated construction the latch bar insert 325 is a metal piece that absorbs stress imparted on the latch bar 245 during movement of the latch bar 245 into and out of engagement with the dipper 70. The latch bar insert 325 is easily removed and replaced when damaged.

The linkage assembly 160 described above advantageously protects the life of its components. For example, and as described above, the second actuation element 155 (or 165) is coupled directly to the pivot structure 205, as opposed to the lever arm 195 itself. Therefore, if the pivot structure 205 fails, the pivot structure 205 can be replaced, without having to replace the entire lever arm 195. Also, the spherical joints between the rod 210 and the lever arm 195 and the latch lever bar 235, as well as the insert 255 (or other implemented bearing structure), increase the life of the linkage assembly 160 components by inhibiting wear and friction.

With reference to FIGS. 18-23, the dipper door 75 includes panels, openings, channels, and cavities that receive and hold the linkage assembly 160 described above. In particular, the dipper door 75 includes a bottom panel 330 and a top panel 335. The bottom panel 330 includes a front edge 340 and a rear edge 345. The bottom panel 330 also includes openings 350 that open to an interior cavity 355 disposed inside the dipper door 75. The openings 350 are spaced generally equally apart from one another along the bottom panel 330. In the illustrated construction at least some of the openings 350 are generally disposed closer to the edge 340 than the edge 345. Five openings 350 are illustrated, although in other constructions different numbers, sizes, shapes, and arrangements of openings 350 are used.

As illustrated in FIGS. 18, 19, 22, and 23, the openings 350 are elongate, and have first ends 360 and second ends 365. The first ends 360 are disposed closer to the edge 345 than the second ends 365. The second ends 365 of the openings 350 are arranged in a generally arched or curved pattern along the bottom panel 330, such that the second ends 365 are aligned along a curved axis 370 that extends along the bottom panel 330. Because at least some of the openings 350 are disposed closer to the edge 340 than the edge 345, the bottom panel 330 includes a solid portion 375 between the curved axis 370 and the edge 345. The solid portion 375 provides structural strength to the bottom panel 330 and to the dipper door 75.

With continued reference to FIGS. 18, 19, 22, and 23, the dipper door 75 also includes ribs 380 that are disposed between the panels 330, 335. Some of the ribs 380 extend directly from the bottom panel 330 to the top panel 335. The ribs 380 provide additional structural support for the dipper door 75 to accommodate for absent material in the openings 350 and the cavity 355, and also help to evenly distribute loads within the dipper door 75 during an impact loading (e.g., when the dipper door 75 slams shut quickly against the dipper 70). Use of the structural ribs 380 allows the top panel 335 to remain generally thin, helping to reduce the overall weight of the dipper door 75, while still maintaining high strength for the dipper door 75. As illustrated in FIGS. 18, 19, 22, and 23, some of the ribs 380 include openings 385 that are sized and shaped to receive, hold, and guide the latch lever bar 235 within the dipper door 75.

Figure 21:
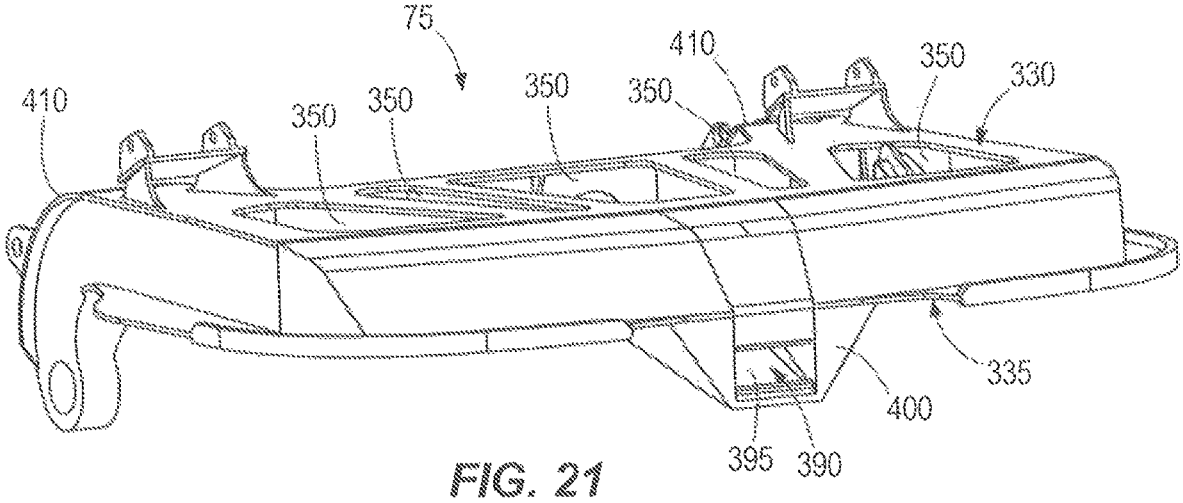
FIG. 21 is a perspective view of the dipper door, illustrating a latch bar housing for the latch bar.

With reference to FIG. 21, the dipper door 75 further includes a latch bar housing 390 forming a channel 395 that extends from the interior cavity 355 to an exterior surface 400 of the dipper door 75. In some constructions the latch bar housing 390 is integrally formed as one piece within the dipper door 75. In some constructions the latch bar housing 390 is a separate piece. The channel 395 is sized and configured to receive the latch bar 245 and the latch bar insert 325. In some constructions the latch bar housing 390 also includes one or more bearings or guide surfaces (e.g., plastic or nylon bearing inserts, roller bearings, other types of rollers, etc.) that facilitate sliding movement of the latch bar 245 within the latch bar housing 390, and inhibit damage to the latch bar 245.

Figure 18:
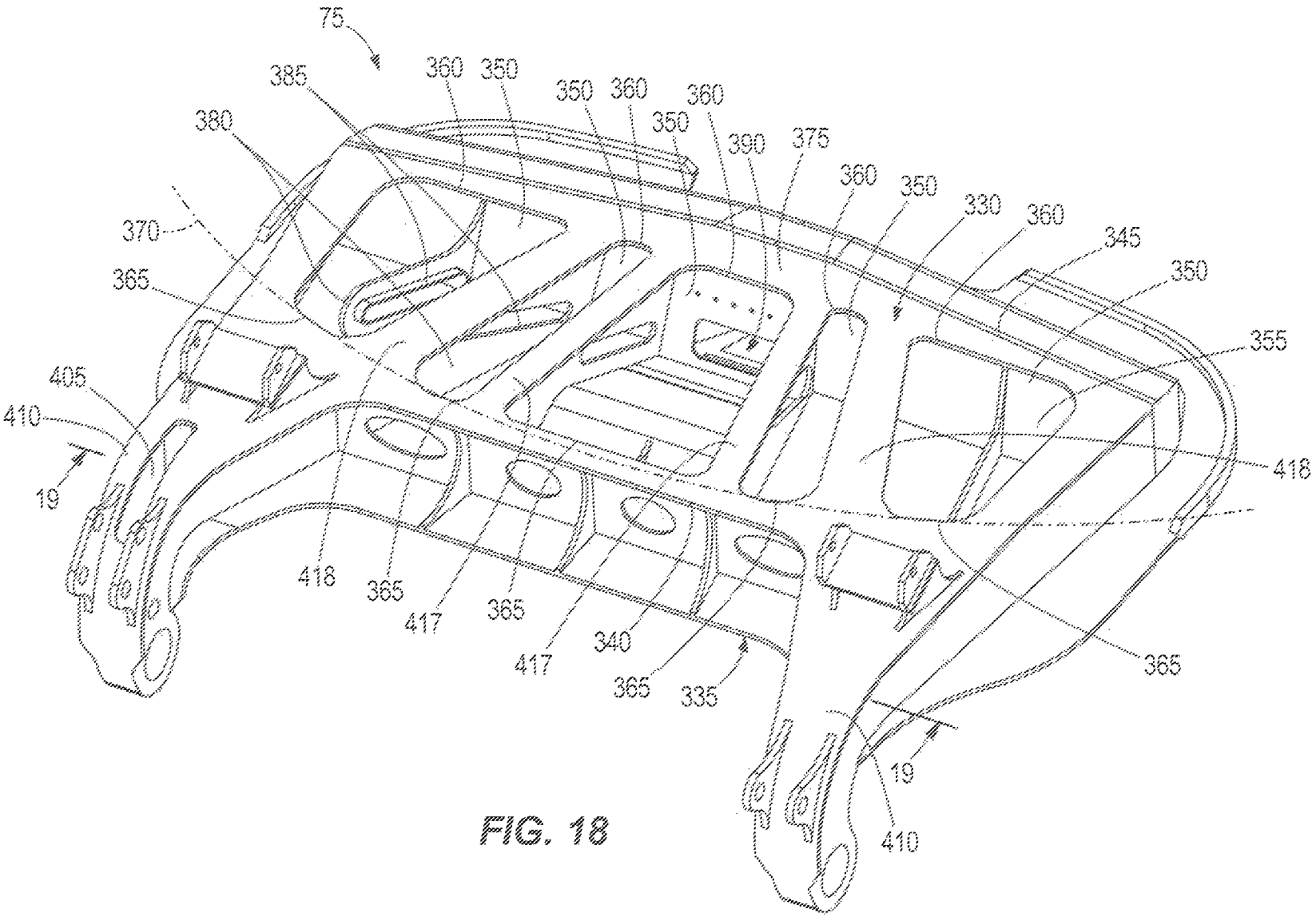
FIG. 18 is a perspective view of the dipper door, illustrating openings and cavities sized to receive and hold the linkage assembly.
Figure 22:
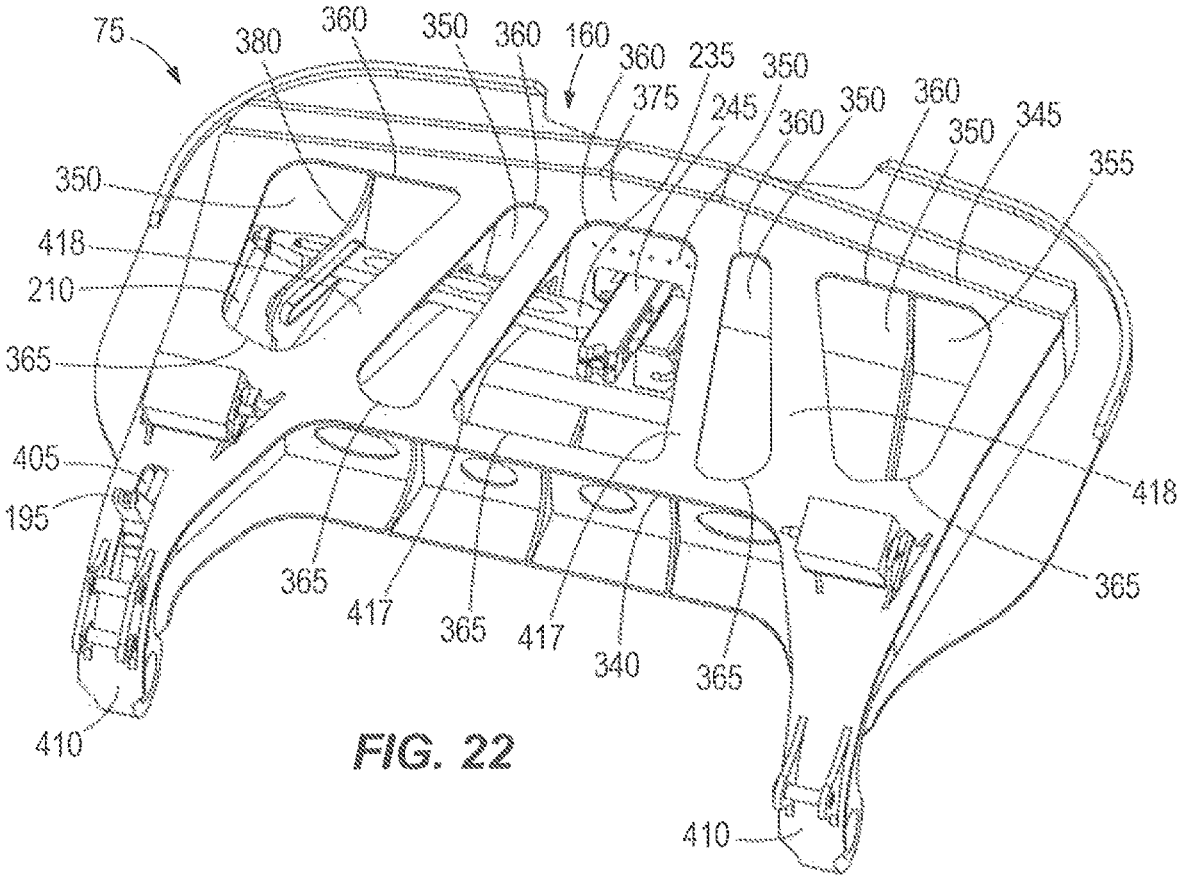
FIGS. 22 and 23 are perspective views of the dipper door, with a portion of the linkage assembly disposed therein.
Figure 23:
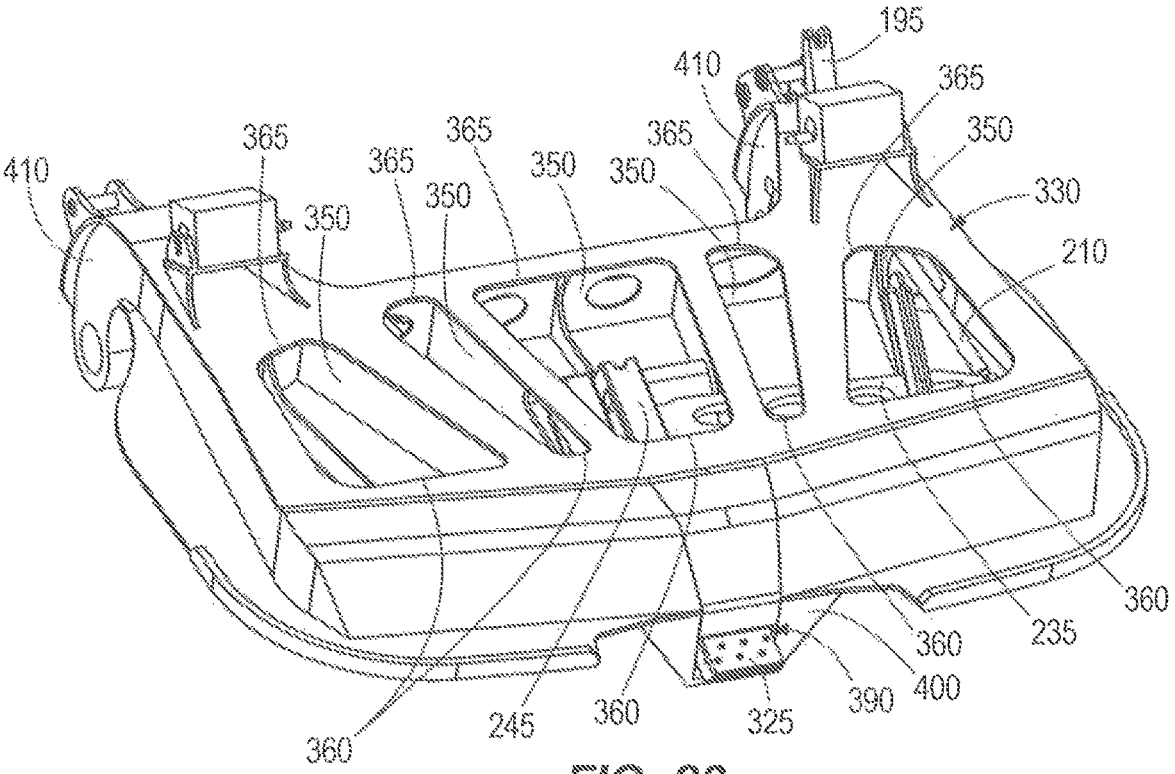

With reference to FIGS. 18 and 22, the dipper door 75 further includes an opening 405 in an arm 410 that receives at least a portion of the lever arm 195, such that the lever arm 195 is disposed at least partially within the arm 410 of the dipper door 75.

Figure 19:
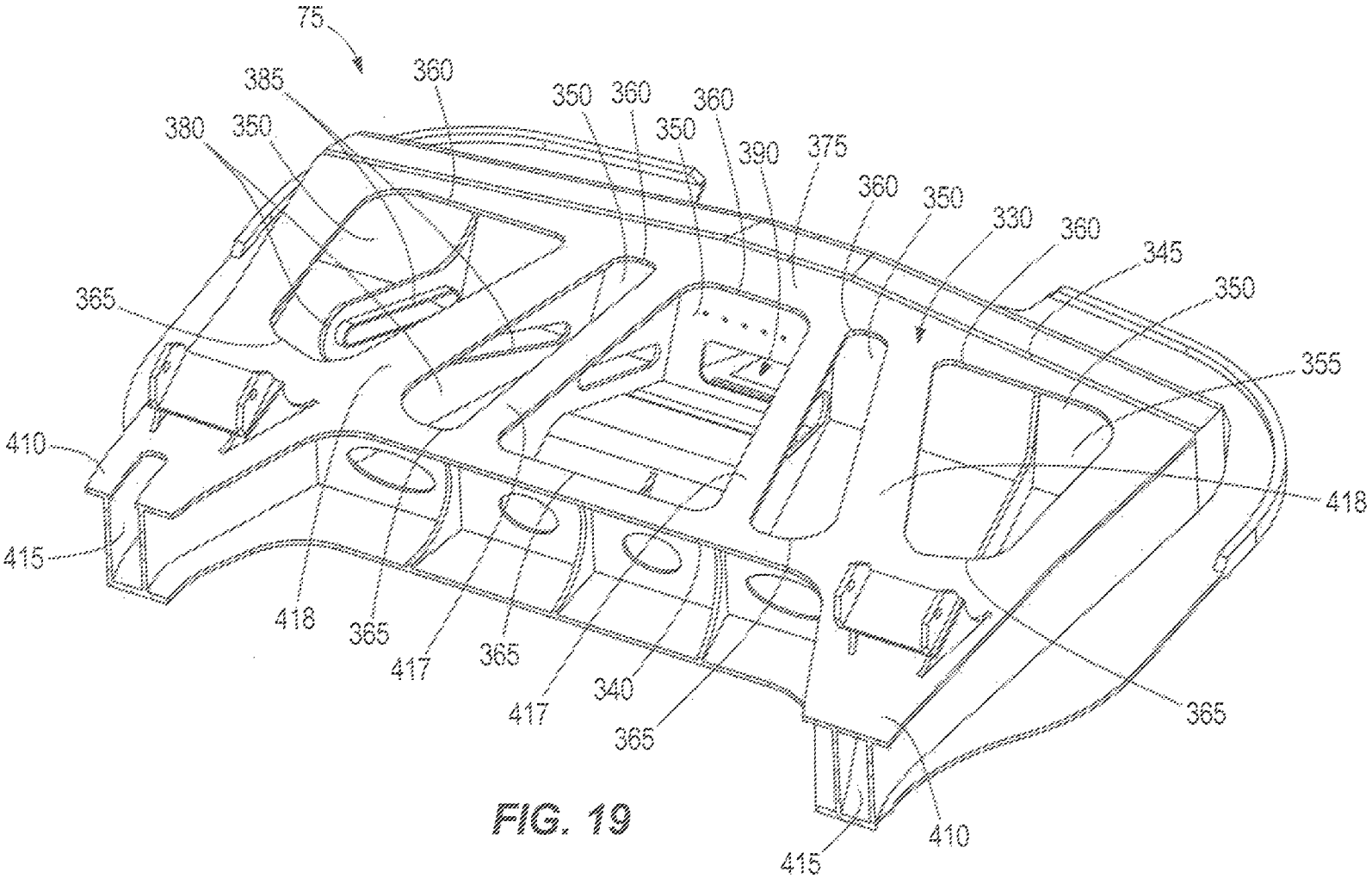
FIG. 19 is a section view of the dipper door, taken along lines 19-19 in FIG. 18, illustrating a channel sized to receive and hold a portion of the linkage assembly.
Figure 20:
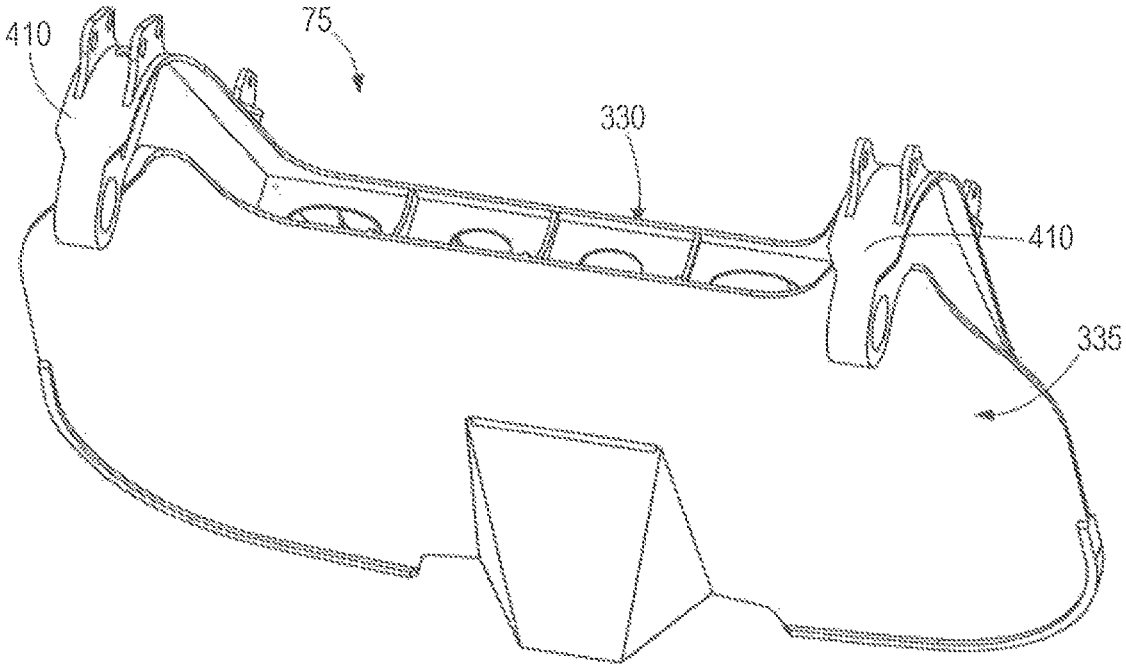
FIG. 20 is a perspective view of the dipper door, illustrating a top panel of the dipper door.

With reference to FIGS. 19 and 22, the arm 410 forms a rectangular, box-like frame defining an interior channel 415 that extends toward the cavity 355. The rod 210, which is coupled to the lever arm 195, extends through the channel 415 and into the cavity 355, where the rod 210 is coupled to the latch lever bar 235. The box-like structure of the arm 410 provides added structural support for the dipper door 75.

With continued reference to FIGS. 18, 19, 22, and 23, dipper door 75 also includes webs 417, 418 that are disposed between the openings 350, the webs 418 being primary webs that are angled directly toward the arms 410. The primary webs 418 absorb a significant amount of load and provide further added strength to the dipper door 75. In some constructions the primary webs 418 provide a load path along the dipper door 75 that absorbs approximately at least 90% of a load acting on the dipper door 75. In some constructions the primary webs 418 absorb between approximately at least 95% of a load acting on the dipper door 75. Other constructions include different ranges.

The openings 350, along with the cavity 355, reduce the amount of material needed for the dipper door 75, which makes the dipper door 75 more light-weight than conventional dipper doors. While the dipper door 75 is more light-weight than conventional dipper doors, in some constructions the dipper door 75 has equal (or even greater) overall structural strength than conventional dipper doors, due at least in part to the arrangement of the solid portion 375, the ribs 380, the box-like structure of the arms 410, the webs 417 and 418, and the top and bottom panels 345, 340 overall.

Figure 24:
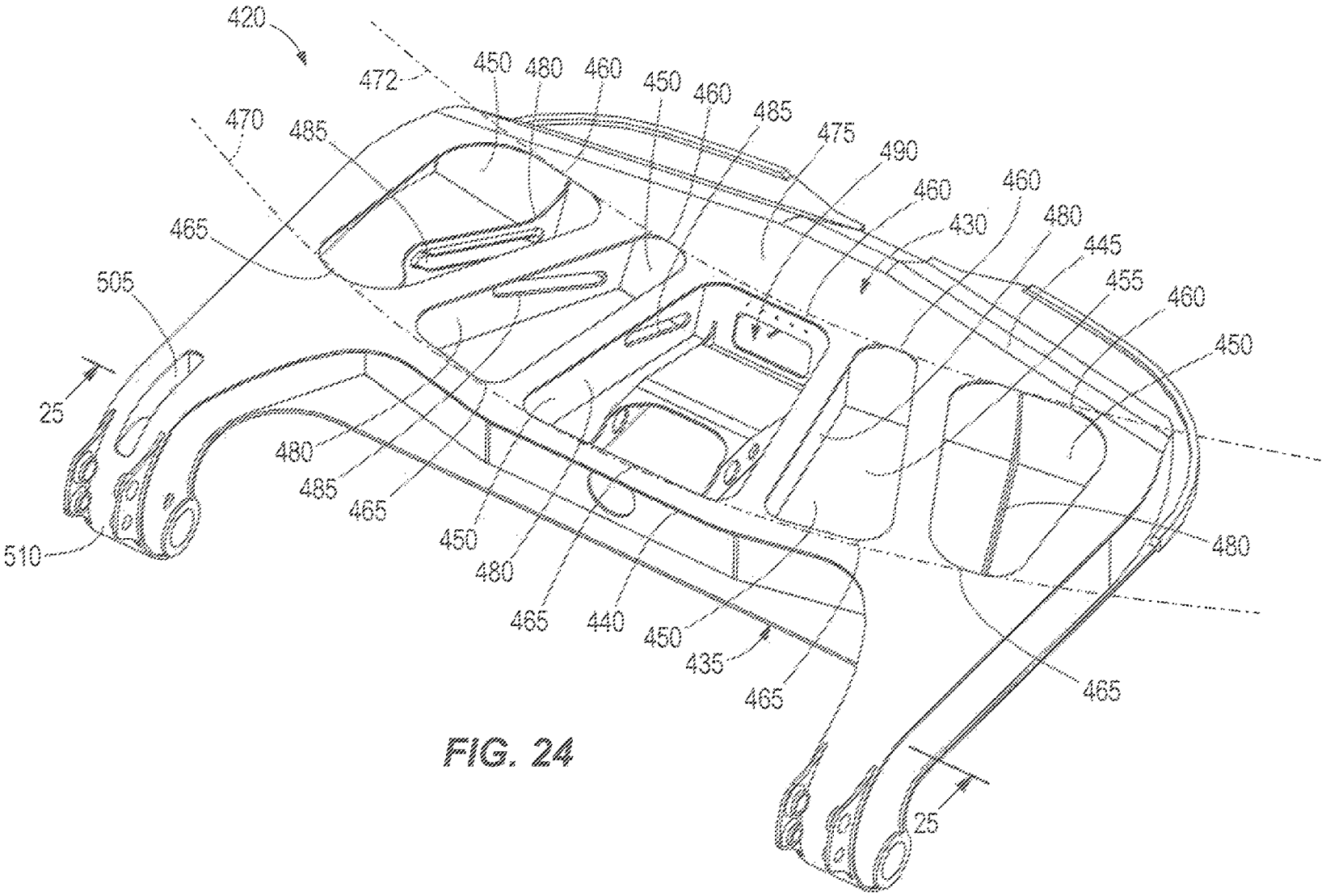
FIG. 24 is a perspective view of an alternative design of the dipper door, illustrating openings and cavities sized to receive and hold the linkage assembly.
Figure 25:
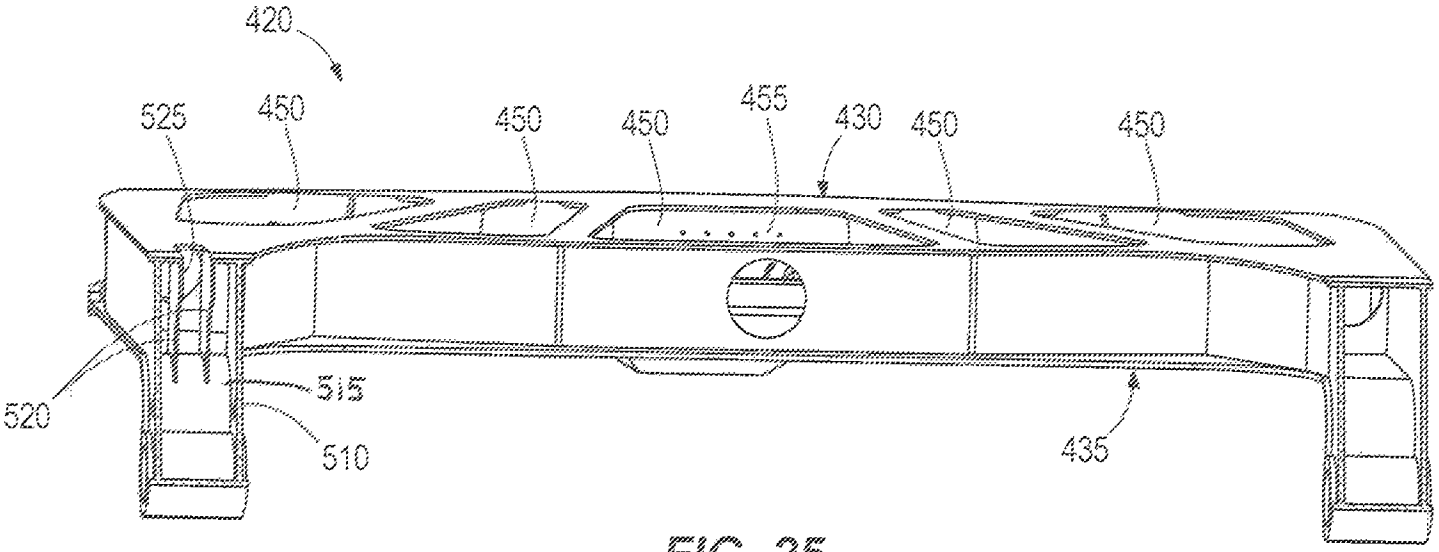
FIG. 25 is a section view of the dipper door, taken along lines 25-25 in FIG. 24, illustrating a channel sized to receive and hold a portion of the linkage assembly.

FIGS. 24 and 25 illustrate an alternative construction of a dipper door 420.

As illustrated in FIGS. 24 and 25, elongate openings 450 are provided, similar to the openings 350, the elongate openings 450 having first ends 460 and second ends 465. Some of the first ends 460 are disposed closer to an edge 440 than the second ends 465. In the illustrated construction of FIGS. 24 and 25, both the first and second ends 460, 465 are arranged in a generally arched or curved pattern along a bottom panel 430, such that the second ends 465 are aligned along a curved axis 470, and the first ends 460 are aligned along a curved axis 472. In some constructions the curved axes 470, 472 are parallel. The panel 430 includes a solid portion 475 between the curved axis 472 and the edge 445.

With reference to FIGS. 24 and 25, the dipper door 420 also includes ribs 480, similar to ribs 380, that are disposed between the panels 430, 435 and include openings 485, as well as a latch bar housing 490 and an opening 505 in an arm 510 that receives the lever arm 195.

Figure 26:
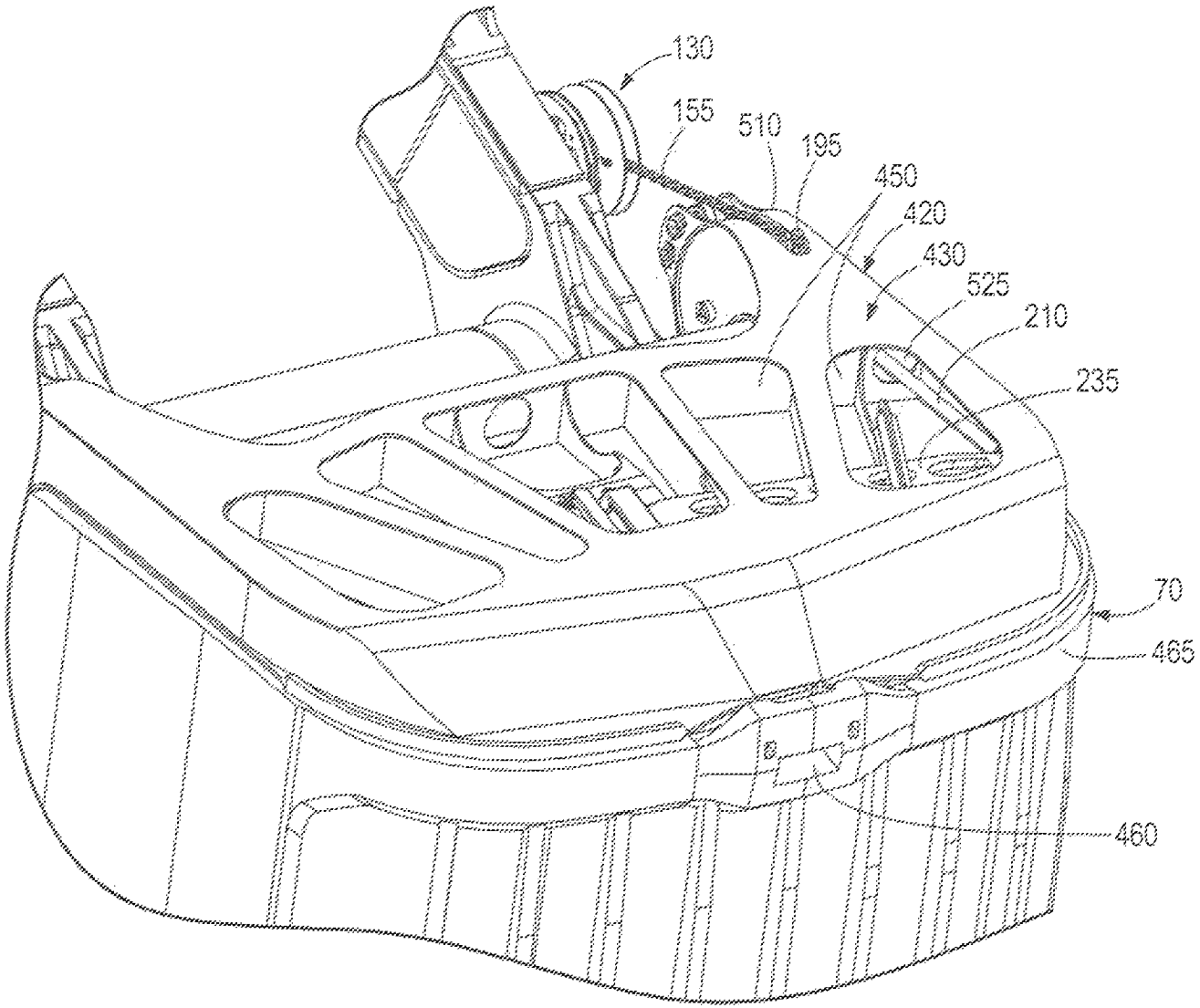
FIG. 26 is a perspective view of the mining shovel, illustrating a channel on the dipper that receives a portion of a linkage assembly to latch a dipper door to the dipper.

As illustrated in FIG. 25, the dipper door 420 includes an interior channel 515 in the arm 510, similar to the channel 415. The dipper door 420 also includes two ribs 520 that extend through the channel 515 and guide the rod 210. The two ribs 520 add further structural support within the arm 510. As illustrated in FIGS. 25 and 26, the rod 210 extends through the channel 515 and through an opening 525 into a cavity 455, where the rod 210 is coupled to the latch lever bar 235.

With reference to FIG. 26, the dipper 70 includes a channel 460 disposed along a lower edge portion 465 of the dipper 70. The channel 460 and the latch bar housing 490 (or 390 in the case of the dipper door 75) are aligned with one another during a latched condition, such that the latch bar insert 325 extends through the latch bar housing 490, 390 and at least partially into the channel 460, thereby locking movement of the dipper door 420, 75 relative to the dipper 70.

With reference to FIGS. 1-26, in order to release the dipper door 420, 75 from the latched condition, the trip motor 120 is activated by the controller 122. When the trip motor 120 is activated the trip motor 120 pulls the first actuation element 125 toward the trip motor 120, thereby causing rotation of the drum portion 140 about the axis 152. As the drum portion 140 rotates, the drum portion 145 also rotates about the axis 152, causing the second actuation element 155 to be pulled toward and wound about the second drum portion 145.

Movement of the second actuation element 155 causes the lever arm 195 to pivot relative to the pivot structure 200, which causes the rod 210 to move (e.g., be pulled up through the opening 300). As the rod 210 is moved, the spherical joints at the first end 215 and the second end 230 of the rod 210 permit relative rotational movement between the rod 210 and both the lever arm 195 and the latch lever bar 235, accounting for any pivoting and arching movement of the lever arm 195 about the pivot structure 200.

As the rod 210 moves, the movement of the rod 210 generates a generally linear movement of the latch lever bar 235, and the movement of the latch lever bar 235 generates a generally linear movement of the latch bar 245 within the latch bar housing 490, 390 (e.g., with the guidance of the housing and pin assembly 272). As the latch bar 245 is moved within the latch bar housing 490, 390, the latch bar insert 325 is pulled away from the dipper 70, thereby freeing the dipper door 420, 75 from the dipper 70, and allowing the dipper door 420, 75 to swing and pivot open relative to the bottom of the dipper 70 to unload material. As the material is unloaded, for example, into a truck or other vehicle, the components of the dipper door trip assembly 115 are positioned to remain well away from the truck and to not interfere with the unloading process.

To return the latch bar insert 325 back into the channel 460 after the material has been unloaded, gravity is used (i.e., the latch bar 245 is naturally urged toward the latched position by gravity). In other constructions, a biasing member or members are used to urge the latch bar 245 and the latch bar insert 325 toward the latched position. Because of the high mechanical advantages and forces possible with the dipper door trip assembly 115 described above, the latch bar insert 325 may be safely extended deep into the channel 460 during this latched condition. This results in a significantly lower likelihood of a false trip and release of the dipper door 420, 75.

Figure 17B:
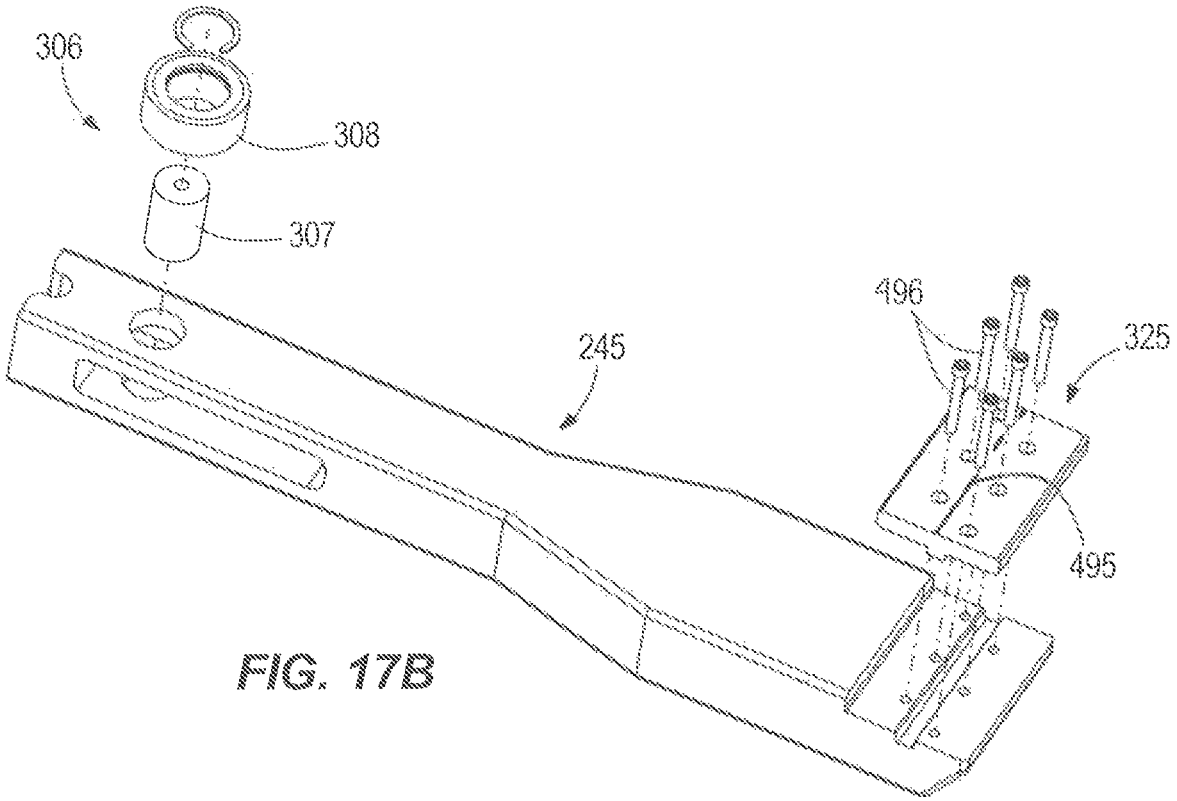

With reference to FIG. 17B, in some constructions the latch bar insert 325 includes a marking 495 (e.g., line, slot, groove, etc.) that aids in aligning the latch bar insert 325 within the latch bar housing 490, 390 during installation or manufacturing of the dipper door 420, 75. For example, in some constructions the latch bar insert 325 is aligned (in a non-latching state) such that the marking 495 coincides with an outer surface (e.g., such as surface 400) of the dipper door 400 or 75, thereby providing an indication that the dipper door trip assembly 115 has been installed correctly. As illustrated in FIG. 17B, in some constructions the latch bar insert 325 is installed with plurality of fasteners 496.

In the event that the dipper door 420, 75 slams quickly against the dipper 70 with high impact (e.g., because of a snubber failure) during the unloading process or during the process of the latch bar 325 returning to the latched position, the dipper door trip assembly 115 is able to absorb and withstand the impact without failing or incurring undesired wear. This is due at least in part to the spherical joints and contoured surfaces within the linkage assembly 160 described above. Similarly, the ribs 480, 380 and webs 417, 418 in the dipper door 420, 75 are also able to absorb and withstand the impact without causing damage to the dipper door 420, 75 or the linkage assembly 160 disposed within the dipper door 75.

Although the invention has been described in detail with reference to certain preferred embodiments, variations and modifications exist within the scope and spirit of one or more independent aspects of the invention as described.

The invention claimed is:

1. A dipper door trip assembly comprising:

a trip drum having a first drum portion and a second drum portion, the first drum portion and the second drum portion both aligned along a common axis of rotation, wherein a diameter of the first drum portion is different than a diameter of the second drum portion; and a mounting structure configured to be directly coupled to a dipper handle, the mounting structure coupled to the trip drum and supporting the first drum portion and the second drum portion for rotation about the axis of rotation.

2. The dipper door trip assembly of claim 1, further comprising a trip motor and a first actuation element extending directly in an uninterrupted path from the trip motor to the first drum portion, wherein the first actuation element is configured to wind and unwind upon the first drum portion.

3. The dipper door trip assembly of claim 2, wherein the first actuation element is one of a wire rope, belt, or chain.

4. The dipper door trip assembly of claim 2, further comprising a second actuation element, and a linkage assembly having a lever arm, wherein the second actuation element extends directly in an uninterrupted path from the second drum portion to the lever arm, and wherein the second actuation element is separately spaced from the first actuation element.

5. The dipper door trip assembly of claim 4, wherein the second actuation element is one of a wire rope, belt, or chain.

6. The dipper door trip assembly of claim 4, wherein the linkage assembly includes a latch bar having an opening sized to receive a latch lever bar, and an insert disposed within the opening, the insert having a bearing surface sized and shaped to engage a surface of the latch lever bar.

7. The dipper door trip assembly of claim 1, wherein the first drum portion includes a first circumferential groove configured to receive a first actuation element, and wherein the second drum portion includes a second circumferential groove configured to receive a second actuation element.

8. The dipper door trip assembly of claim 1, wherein a ratio of the first diameter to the second diameter is greater than 2.0.

9. The dipper door trip assembly of claim 8, wherein the ratio is between 2.0 and 4.0.

10. The dipper door trip assembly of claim 1, wherein the first drum portion and the second drum portion are aligned along a common shaft that defines the axis of rotation.

11. A mining machine comprising:

a boom;

the dipper handle coupled to the boom;

a dipper coupled to an end of the dipper handle; and the dipper door trip assembly of claim 1.

* * * * *